US009798280B2

(12) United States Patent
Omata

(10) Patent No.: US 9,798,280 B2
(45) Date of Patent: Oct. 24, 2017

(54) HEATING APPARATUS AND IMAGE FORMING APPARATUS

(71) Applicant: CANON KABUSHIKI KAISHA, Tokyo (JP)

(72) Inventor: Masahito Omata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/175,347

(22) Filed: Jun. 7, 2016

(65) Prior Publication Data

US 2016/0363894 A1 Dec. 15, 2016

(30) Foreign Application Priority Data

Jun. 12, 2015 (JP) ..... 2015-119552

(51) Int. Cl.
*G03G 15/20* (2006.01)

(52) U.S. Cl.
CPC ..... *G03G 15/2053* (2013.01)

(58) Field of Classification Search
CPC combination set(s) only.
See application file for complete search history.

(56) References Cited

U.S. PATENT DOCUMENTS 5,210,579 A * 5/1993 Setoriyama ..... G03G 15/2064 219/216
9,213,276 B2 12/2015 Mitani et al.
9,274,474 B2 3/2016 Omata et al.
2005/0008411 A1* 1/2005 Chung ..... G03G 15/2064 399/328
2014/0314458 A1 10/2014 Mitani et al.
2015/0086253 A1 3/2015 Omata et al.

FOREIGN PATENT DOCUMENTS

| | | | |
|---|---|---|---|
| JP | H04-044075 | A | 2/1992 |
| JP | H04-044076 | A | 2/1992 |
| JP | H04-044077 | A | 2/1992 |
| JP | H04-044078 | A | 2/1992 |
| JP | H04-044079 | A | 2/1992 |
| JP | H04-044080 | A | 2/1992 |
| JP | H04-044081 | A | 2/1992 |
| JP | H04-044082 | A | 2/1992 |

(Continued)

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

The fixing apparatus includes a heating rotary member that heats the toner image on a recording medium, a pressure member that comes in contact with the heating rotary member, wherein the recording medium provided with the toner image is conveyed at a nip portion, a cover that covers part of an outer surface of the heating rotary member to form a space with the heating rotary member and extends in a longitudinal direction of the heating rotary member, the cover including a partition including a surface perpendicular to a longitudinal direction on a cover end portion in the longitudinal direction and partitioning the space and outside of the space, and a flange provided on an end portion on a same side as the partition in the longitudinal direction and including an extending portion extending in a direction approaching the cover.

10 Claims, 20 Drawing Sheets

(56) References Cited

FOREIGN PATENT DOCUMENTS

| | | | |
|---|---|---|---|
| JP | H04-044083 | A | 2/1992 |
| JP | H04-204980 | A | 7/1992 |
| JP | H04-204981 | A | 7/1992 |
| JP | H04-204982 | A | 7/1992 |
| JP | H04-204983 | A | 7/1992 |
| JP | H04-204984 | A | 7/1992 |
| JP | H08-184992 | A | 7/1996 |
| JP | 2000-003070 | A | 1/2000 |
| JP | 2011-237555 | A | 11/2011 |
| JP | 2014-232308 | A | 12/2014 |
| JP | 2015-064529 | A | 4/2015 |

* cited by examiner

HEATING APPARATUS AND IMAGE FORMING APPARATUS

BACKGROUND OF THE INVENTION

Field of the Invention

The present invention relates to a heating fixing apparatus used in an image forming apparatus.

Description of the Related Art

Conventionally, an electrophotographic process is used in an image forming apparatus, such as an electrophotographic copying machine and an electrophotographic printer, and a fixing unit applies a heat fixing process to a toner image formed on a recording medium. A release wax is often included as a constituent material of electrophotographic toner in recent years. The release wax is included to adjust glossiness of a print image or to provide an effect of dispersibility of a pigment, and the release wax is added to prevent a fixation offset.

There are several types of phenomena of fixation offsets as illustrated below. When heating of a fixing member is insufficient (low temperature) in a fixing process on a recording medium, toner is not sufficiently melted, and fixing strength on the recording medium is small. Therefore, part of the toner is attached to the member. This phenomenon is called a cold offset, and the part of the fixing member with the toner appears as a defect of an image on the recording medium. The fixing strength of the fixed toner is weak, and the toner may be peeled off from the recording medium due to friction or the like. On the other hand, although the toner is sufficiently melted when the temperature of the fixing member is too high, viscosity is reduced. Part of the melted toner is peeled off from the recording medium, and the surface of the fixing member is contaminated. This phenomenon is called a hot offset that causes an image defect on the recording medium as in the cold offset.

Adding a wax component as a release agent to the toner is proposed in order to prevent the fixation offsets (Japanese Patent Application Laid-Open No. H08-184992). The release wax is included in the toner, and the release wax moves to an interface between the melted toner and the fixing member during heating and fixing. In this way, offset resistance can be improved. A technique of adding two or more types of release waxes to the toner is also proposed in order to improve the offset resistance (Japanese Patent Application Laid-Open No. 2000-3070).

Although a toner image is fixed on the recording medium by heating the toner in the fixing apparatuses, ultra-fine particles (UFP) may be generated from the toner or grease due to heat during heating.

SUMMARY OF THE INVENTION

The present invention provides a fixing apparatus that fixes a toner image on a recording medium, the apparatus including a heating rotary member configured to heat the toner image, a pressure member configured to come in contact with the heating rotary member to form a nip portion, wherein the recording medium provided with the toner image is conveyed at the nip portion, a cover configured to cover part of an outer surface of the heating rotary member to form a space together with the heating rotary member, the cover extending in a longitudinal direction of the heating rotary member, the cover comprising a partition including a surface, which an extension in the longitudinal direction of the heating rotary member intersects, on an end portion of the cover in the longitudinal direction of the heating rotary member and partitioning the space and outside of the space, and a flange provided on an end portion of the heating rotary member on a same side as the partition in the longitudinal direction of the heating rotary member and comprising an extending portion extending in a direction approaching the cover.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Modes for carrying out the invention will be exemplarily described in detail based on embodiments with reference to the drawings. However, dimensions, materials, shapes and relative arrangements of constituent components described in the embodiments should be appropriately changed according to the configuration and various conditions of an apparatus in which the invention is applied. Therefore, the modes are not intended to limit the scope of the invention to the following embodiments.

<Image Forming Apparatus>

Figure 2:
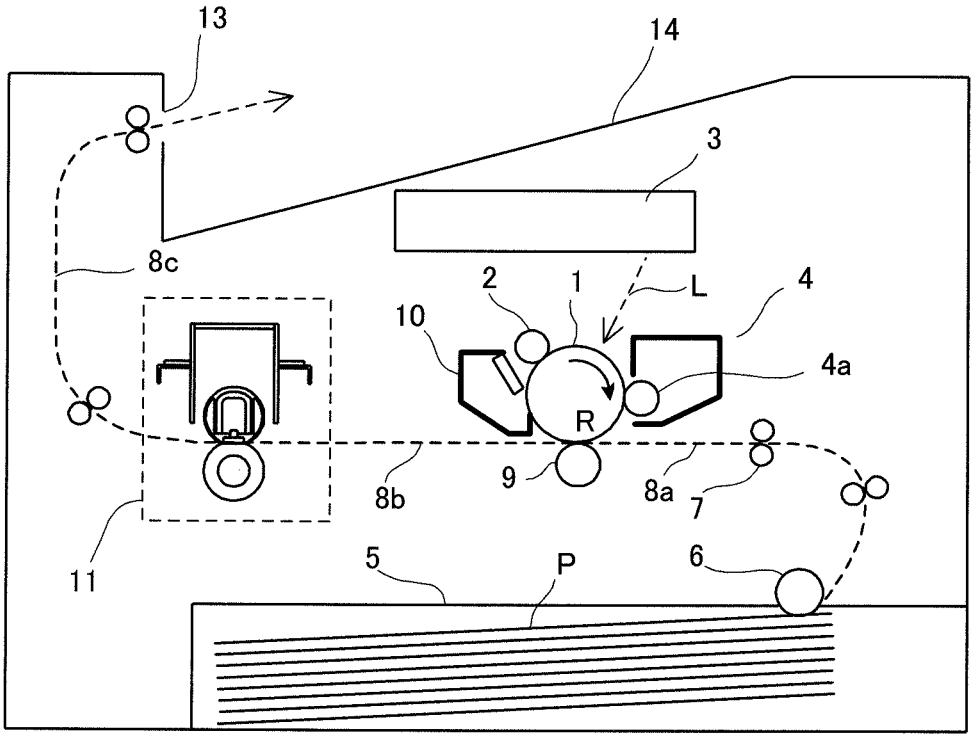
FIG. 2 is a schematic cross-sectional view of an image forming apparatus according to the embodiments of the present invention.

FIG. 2 is a schematic cross-sectional view illustrating a schematic configuration of an example of an image forming apparatus according to the embodiments of the present invention. The image forming apparatus of the present embodiments is a laser beam printer using a transfer type electrophotographic process. The laser beam printer includes an electrophotographic photosensitive drum 1 as an image bearing member, a charging device 2, a laser beam scanner 3, a developing device 4 and a paper feeding cassette 5. The electrophotographic photosensitive drum 1 is rotated and driven clockwise indicated by an arrow, at a predetermined peripheral speed (process speed). The charging device 2 is a contact charging roller or the like, and a surface of the photosensitive drum 1 is uniformly charged (primary charge) by the charging device 2 with predetermined polarity and potential. The laser beam scanner 3 is a laser beam scanner 3 that is an image exposing unit. The laser beam scanner 3 outputs laser light L after on/off modulation according to a time-series electrical digital pixel signal of target image information input from an external device, such as an image scanner and a computer (not illustrated), and scans and exposes (irradiates) the charged surface of the photosensitive drum 1. The electric charge of an exposed bright section of the surface of the photosensitive drum 1 is removed by the scan and exposure, and an electrostatic latent image corresponding to the target image information is formed on the surface of the photosensitive drum 1. The developing device 4 supplies a developing agent (toner) from a developing sleeve 4*a* to the surface of the photosensitive drum 1 and sequentially develops the electrostatic latent image on the surface of the photosensitive drum 1 onto the surface of the photosensitive drum 1 as a toner image that is a transferable image. A reversal development system is generally used in the laser beam printer, in which the toner is attached to the exposed bright section of the electrostatic latent image to develop the image.

The paper feeding cassette 5 stores and houses a recording medium P. The paper feeding cassette 5 includes a paper feeding roller 6 driven based on a paper feeding start signal. In the paper feeding cassette 5, the paper feeding roller 6 separates and feeds each sheet of the recording medium P in the paper feeding cassette 5. The recording medium P passes through registration rollers 7 and a sheet path 8*a* and is introduced at predetermined timing to a transfer portion R that is a contact nip portion between the photosensitive drum 1 and a transfer roller 9 as a contact rotary transfer member. More specifically, the registration rollers 7 control the conveyance of the recording medium P so that a tip portion of the recording medium P reaches the transfer portion R at the same time when a tip portion of the toner image on the photosensitive drum 1 reaches the transfer portion R. The recording medium P introduced to the transfer portion R is sandwiched and conveyed through the transfer portion R, and meanwhile, a transfer bias power source (not illustrated) applies a transfer bias with a polarity opposite the toner to the transfer roller 9. As a result, the toner image on the surface side of the photosensitive drum 1 is electrostatically transferred to the surface of the recording medium P at the transfer portion R. A configuration regarding the process of forming an unfixed toner image on the recording medium P corresponds to an image forming unit of the present invention.

The recording medium P provided with the toner image at the transfer portion R is separated from the surface of the photosensitive drum 1 and is conveyed and introduced to a heating apparatus 11 through a sheet path 8*b*. A heat/pressure fixing process is applied to the toner image. Meanwhile, a cleaning apparatus 10 removes transfer residual toner and paper powder to clean the surface of the photosensitive drum 1 after the separation of the recording medium (after the transfer of the toner image to the recording medium P), and the photosensitive drum 1 is repeatedly used to create images. After passing through the heating apparatus 11, the recording medium P is guided toward a sheet path 8*c* and is discharged onto a paper discharge tray 14 from a discharge port 13.

<Heating Apparatus>

Figure 1:
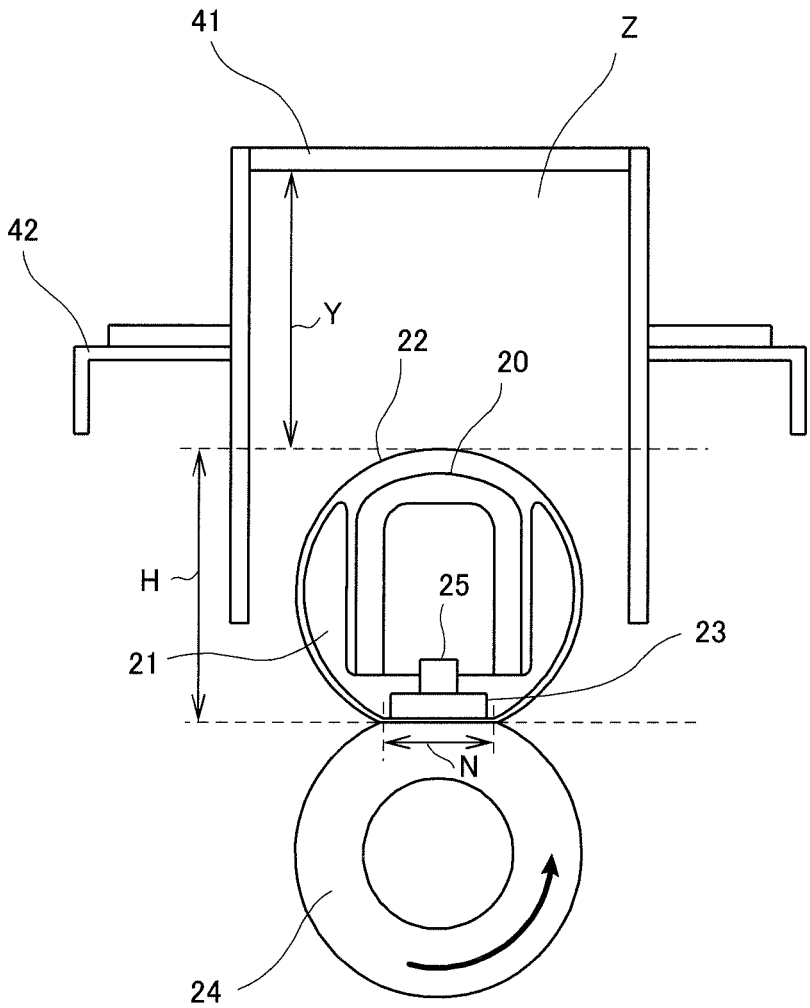
FIG. 1 is a schematic cross-sectional view of a heating apparatus according to embodiments of the present invention.

FIG. 1 is a schematic cross-sectional view illustrating a schematic configuration of a heating fixing apparatus of a film heating system according to the present embodiments. The apparatus is a tensionless type apparatus disclosed in Japanese Patent Application Laid-Open Nos. H04-44075 to 44083 and H04-204980 to 204984. This type of heating fixing apparatus includes a heat-resistant film (heating rotary member) 22 that is an endless belt-shaped or cylindrical flexible member. At least part of the circumference of the heat-resistant film 22 is always tension-free (tension is not applied), and the film is rotated and driven by rotary drive force of a pressure body. The heating fixing apparatus includes a reinforcing rigid member 20, a film guide 21, the heat-resistant film 22 and a ceramic heater 23.

The film guide 21 is a heat-resistant rigid member that rotatably supports the heat-resistant film 22 and that serves as a heating element holding member and a guide member (support member) of a film. The reinforcing rigid member 20 is made of, for example, a metal channel member and functions as a rigid member for reinforcing the film guide 21. The ceramic heater 23 is a heating element that heats the film 22 (fixing nip portion) and is installed and held to oppose the inner circumferential surface of the film 22 in the longitudinal direction of the lower surface of the film guide 21. The endless (cylindrical) heat-resistant film 22 is made of a flexible heat-resistant member and is fitted onto the film guide (stay) 21 that is a film guide member including the heating element 23. The inner circumferential length of the endless heat-resistant film 22 is, for example, about 3 mm greater than the outer circumferential length of the film guide 21 including the heating element 23. Therefore, the film 22 is fitted with some room in the circumference.

The film guide 21 is made of a high heat resistance resin, such as polyimide, polyamide imide, PEEK, PPS and liquid crystal polymer, or a composite material of these resins and ceramics, metal or glass. A liquid crystal polymer is used in the present embodiments. A U-shaped sheet metal can be formed by metal, such as SUS and iron. A heat-resistant single-layer film or multi-layer film with a film thickness of 100 μm or less, preferably 40 μm to 90 μm, can be used for the film 22 to reduce the thermal capacity to improve the quick start feature. Examples of the material of the single-layer film include PTFE, PFA and FEP. The multi-layer film can be formed by coating PTFE, PFA, or FEP on the outer circumferential surface of a film made of polyimide, polyamide imide, PEEK, PES or PPS. In the present embodiments, PFA is coated on the outer circumferential surface of a polyimide film with a thickness of about 50 μm. The outside diameter of the film 22 is 18 mm.

The film 22 is rubbed against the heating element and the film guide 21 (heating support), and heat-resistant fixing grease (not illustrated) is applied on the film inner surface to reduce the rubbing resistance. Examples of the heat-resistant fixing grease include a silicone oil, such as dimethylsiloxane, methylphenylsiloxane and methylhydrosiloxane, and a fluorine oil, such as perfluoroether. A mixture of these oils and a heat-resistant fluororesin (such as PFA, PTFA and FEP) fine particles can also be used.

A pressure roller (pressure rotary member) 24 is a film outer surface contact drive unit that places the heat-resistant film 22 between the pressure roller 24 and the heating element 23 to form a nip area N (fixing nip portion) and that rotates and drives the film 22. The pressure roller 24 includes a cored bar, an elastic body layer, and a mold release layer that is an outermost layer. A bearing unit and an energization unit (not illustrated) cause the pressure roller 24 to sandwich the film 22 with predetermined pressing force, and the pressure roller 24 is pressed against and installed on the surface of the heating element 23. In the present embodiments, plated iron is used for the cored bar, and silicone rubber is used for the elastic body layer. A PFA tube with a thickness of about 30 μm is used for the mold release layer. The outside diameter of the pressure roller 24 is 20 mm, and the thickness of the elastic body layer is 3 mm.

A driving system (not illustrated) rotates and drives the pressure roller 24 at a predetermined peripheral speed in a direction of an arrow. As a result of the rotation and drive of the pressure roller 24, rotation force acts on the film 22 due to frictional force between the outer circumferential surface of the pressure roller 24 and the outer surface (outer circumferential surface) of the film 22 at the nip portion N, and the film 22 also rotates. The inner surface (inner circumferential surface) side of the film 22 comes in close contact with and slides over the surface of the heating element 23 at the nip portion N, and the film 22 follows the pressure roller 24 and rotates at substantially the same peripheral speed as the rotation peripheral speed of the pressure roller 24 in a direction of an arrow on the circumference of the film guide 21.

Figure 3:
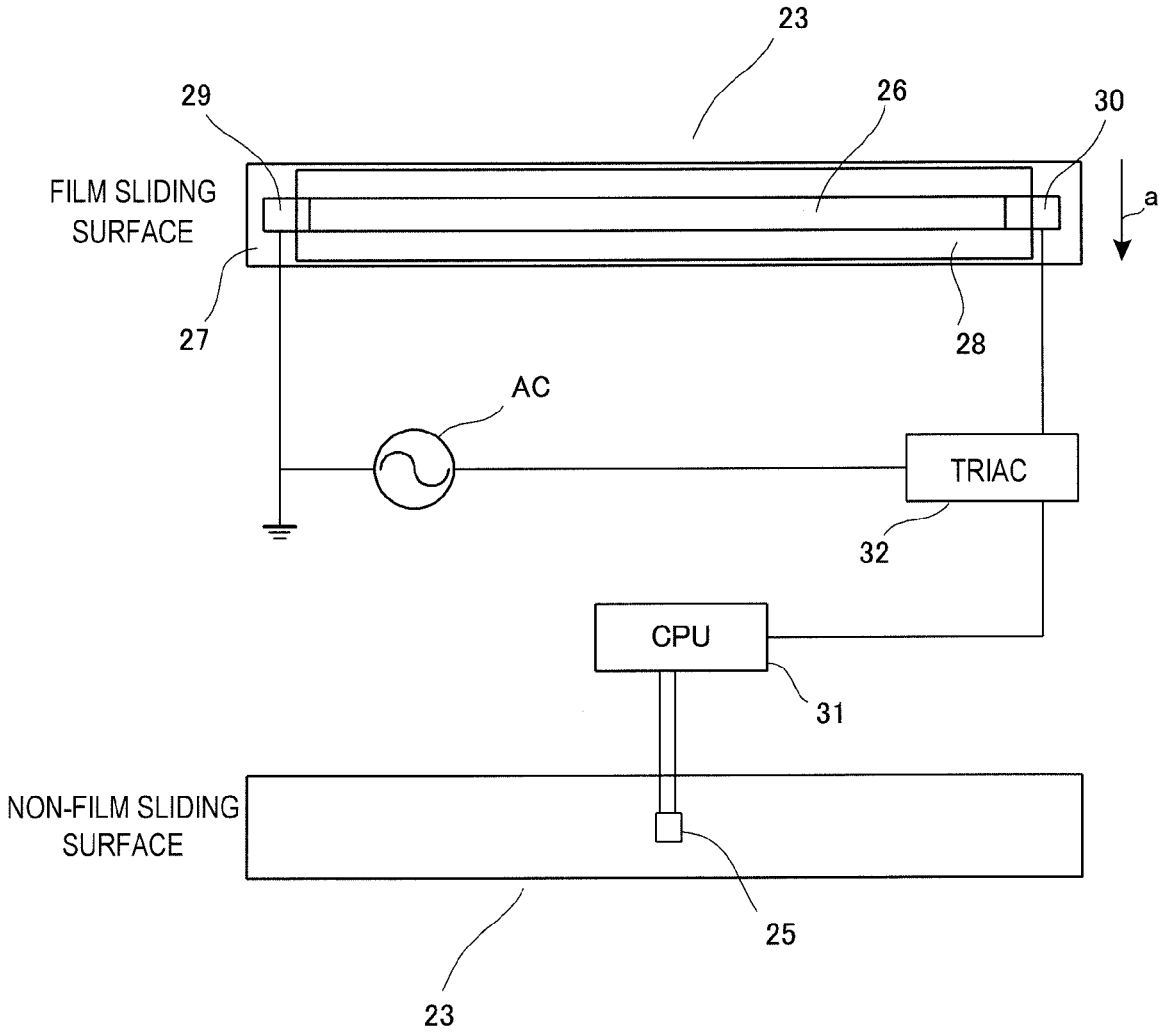
FIG. 3 is a diagram illustrating a configuration of a heating element and a configuration of an electrification control circuit.

FIG. 3 is a schematic diagram illustrating a configuration of the heating element 23 and a circuit configuration for controlling electrification of the heating element 23 according to the present embodiments. The heating element 23 is a heating element with a low thermal capacity as a whole including a substrate 27, a resistance heating member 26, a heat-resistant overcoat layer 28, and power feeding electrodes 29 and 30 provided on a longitudinal end portion of the resistance heating member 26. The substrate 27 is an elongated heat-resistant insulating substrate with an excellent thermal conductivity in which a right-angle direction relative to a conveyance direction a of the recording medium P as a heated material is the longitudinal direction. The resistance heating member 26 is formed in the longitudinal direction of the substrate on the surface (film sliding surface) side of the substrate 27. The heat-resistant overcoat layer 28 protects a heating element surface forming the resistance heating member 26.

Silver, palladium, glass powder (inorganic binding agent) and an organic binding agent are mixed and blended to obtain a paste, and the paste is formed in a linear belt-like shape on the substrate 27 by screen printing to obtain the resistance heating member 26 of the present embodiments. Other than silver palladium (Ag/Pd), an electric resistance material, such as $RuO_2$ and $Ta_2N$, can be used for the material of the resistance heating member. A resistance value of the resistance heating member is 20Ω at room temperature. A ceramics material, such as alumina and aluminum nitride, is used for the substrate 27 as a heat-resistant insulating substrate. In the present embodiments, an alumina substrate with a width of 7 mm, a length of 270 mm, and a thickness of 1 mm is used. A screen printing pattern of silver palladium is used for the power feeding electrodes 29 and 30. The overcoat layer 28 of the resistance heating member 26 is mainly intended to secure electrical insulation between the resistance heating member 26 and the surface of the heating element 23 as well as slidability of the film 22. In the present embodiments, a heat-resistant glass layer with a thickness of about 50 μm is used for the overcoat layer 28.

FIG. 3 also illustrates a back surface (non-film sliding surface) of the heating element 23. A temperature detection element 25 is provided to detect the temperature of the heating element. In the present embodiments, an external contact-type thermistor separated from the heating element 23 is used as the temperature detection element. In the thermistor 25, for example, a heat insulating layer is provided on a support, and an element of a chip thermistor is fixed on the heat insulating layer. The element is brought into contact with the back surface of the heating element by predetermined pressure force with the element facing downward (back surface side of heating element). In the present embodiments, a highly heat-resistant liquid crystal polymer is used as a support, and ceramics paper is laminated to form a heat insulating layer. The thermistor 25 is provided in a sheet feeding area of minimum-sized recording paper and communicates with a CPU 31. The heating element 23 is exposed with the front surface side provided with the overcoat layer 28 facing down, and the heating element 23 is held and fixed to the lower side of the film guide 21. According to the configuration, the thermal capacity of the entire heating element can be lower than in a heat roller system, and quick start is possible.

An alternating current power source AC feeds power to the power feeding electrodes 29 and 30 at longitudinal end portions of the resistance heating member, and the resistance heating member 26 generates heat throughout the entire length in the longitudinal direction to raise the temperature of the heating element 23. The external contact-type thermistor 25 detects the rise in temperature. The CPU 31 imports the output of the external contact-type thermistor 25 after A/D conversion, and based on the information, the power applied to the resistance heating member 26 by a triac 32 is controlled by phase control or wave number control. In this way, the temperature of the heating element 23 is controlled. More specifically, the temperature of the heating element 23 is raised if the temperature detected by the external contact-type thermistor 25 is lower than a predetermined set temperature, and the temperature is lowered if the temperature is higher than the set temperature. In this way, the electrification is controlled to maintain the heating element 23 at a certain temperature during the fixation. In the present embodiments, the output is changed by the phase control in 21 levels from 0 to 100% in increments of 5%. The output of 100% indicates an output when the heating element 23 is fully electrified.

In a state that the heating element 23 is activated at a predetermined temperature and the rotation peripheral speed of the film 22 by the rotation of the pressure roller 24 is steady, a transfer unit introduces, to the nip portion N, the recording medium P as a material to be heated for which the image is to be fixed. The recording medium P is sandwiched and conveyed through the pressure welding nip portion N along with the film 22, and the heat of the heating element 23 is provided to the recording medium P through the film 22 to heat and fix an unfixed image (unfixed toner image) on the recording medium P to the surface of the recording medium P. The recording medium P passing through the nip portion N is separated from the surface of the film 22 and conveyed.

Figure 4:
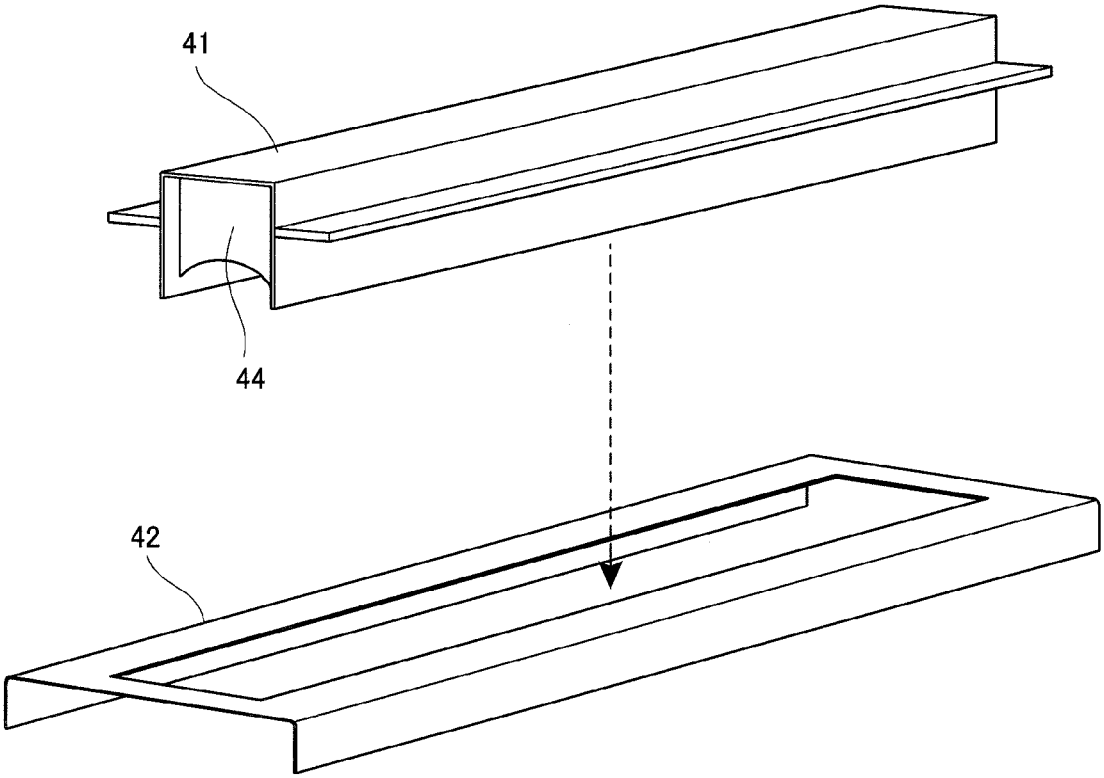
FIG. 4 is a perspective view of a detention member and a top plate frame according to an embodiment 1.

FIG. 1 illustrates a detention member (cover) 41 in the present embodiments. The detention member extends in the longitudinal direction of the film 22 and covers part of the outer surface of the film 22. The detention member is a member that temporarily retains UFP (ultrafine particles) generated from the surface of the film 22 of the heating apparatus 11 or from around the heating element 23 in a space (retention space Z) inside of the detention member (formed between the detention member and the film 22). As illustrated in FIG. 4, the detention member 41 is fitted into a frame of a top plate frame 42. The top plate frame 42 is fixed to a fixing frame (not illustrated) that is an outer frame of the heating apparatus 11, and the detention member 41 is fixed on the film 22 (opposite side of the nip portion N). Examples of the material of the detention member 41 include a high heat resistance resin, such as polyimide, polyamide imide, PEEK, PPS and liquid crystal polymer, a material, such as ceramics, metal and heat-resistant glass, and a composite material of these.

<Generation Mechanism of UFP>

A wax in the toner is liquefied by the heat and the pressure when the toner image passes through the nip N and is permeated to the surface of the toner from the inside of the toner. In this case, part of the wax is vaporized and released into the air. A small amount of part of the wax remains on the surface of the film 22 after passing through the nip N, and the wax is continuously heated by the film 22 and vaporized. The vaporized wax enters a liquid-phase or solid-phase fine particle state (UFP) due to the ambient temperature, and the wax floats on an air flow around the heating apparatus 11. The UFP is also generated from the sliding grease around the ceramic heater 23 that is a heating element, during heating by the heater 23. Although the sliding grease is heat-resistant, a small amount of the sliding grease is vaporized during heating by the heater and comes out from both end portions of the film 22. The sliding grease becomes liquid-phase UFP due to the ambient temperature and floats on an air flow around the heating apparatus 11.

Here, examples of the air flow around the heating apparatus 11 include an air flow caused by a cooling fan in the image forming apparatus, an air flow generated along with the conveyance of the recording medium P and an air flow generated by heating of the recording medium P by the heating apparatus 11. As for the direction of the air flow, an air flow blowing into the heating apparatus 11 from the upstream side in the recording medium conveyance direction sends the UFP to the outside of the device through the conveyance path (sheet path 8*c* of FIG. 2) of the recording medium P or the like, and this has a particularly large effect on the release of the UFP to the outside of the device.

The UFP in the floating state is easily condensed if the floating state is long and is easily adsorbed to surrounding members. Therefore, condensing of the UFP in the floating state can be induced from the viewpoint of reducing the release of the UFP to the outside of the device. The UFP tends to be condensed when the temperature is high and when the UFP is floating at a high concentration. Therefore, to progress the condensing, the air flow carrying the UFP can be reduced as much as possible around the generation source to stagnate the UFP (hereinafter, written as "retain the UFP").

On that account, a greater retention space Z of the detention member 41 is better. It is also desirable that the retention space Z is a space long in the direction away from the film 22 as in the present embodiment. Due to a reason described later, the position of the wall tip of the detention member 41 can be close to the recording medium conveyance surface to weaken the air flow flowing into the retention space Z, and the time that the UFP is retained inside of the detention member 41 can be increased. Therefore, it is necessary that the detention member 41 covers around the film 22 that is a generation source of the UFP to retain the UFP just after the generation in the retention space Z. More specifically, (1) the path of the air flow for carrying the UFP from the generation source to the outside of the device can be elongated, and (2) the speed of the air flow carrying the UFP from the generation source to the outside of the device can be reduced. These can promote the condensing of the UFP and the adsorption to the surrounding members to reduce the release of the UFP to the outside of the device.

<Detention Member>

Figure 5:
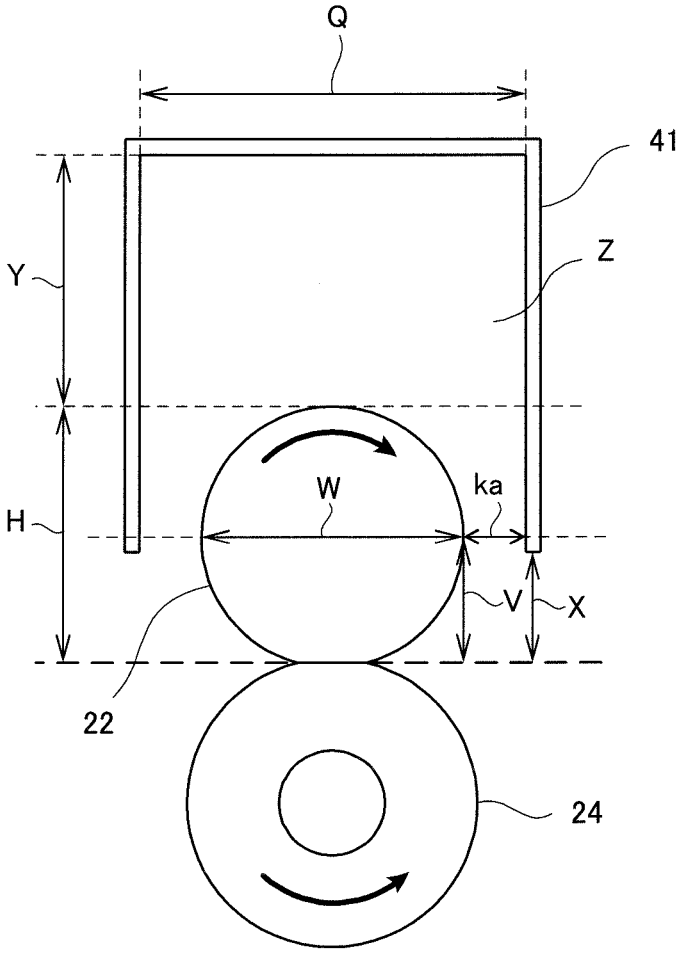
FIG. 5 is a schematic cross-sectional view of the heating apparatus according to the embodiment 1.

FIG. 5 is a schematic cross-sectional view illustrating definition of main dimensions of the heating apparatus 11 (detention member 41) according to the present embodiments. A maximum height of the film 22 as viewed from the recording medium conveyance surface (in the perpendicular direction from the recording medium conveyance surface) is H, and a height of the inner surface of the detention member 41 measured from the maximum height of the film 22 is Y. A distance between an upstream wall (upstream side cover) of the detention member 41 in the conveyance direction of the recording medium and the outer surface of the film 22 (distance in the recording medium conveyance direction) is ka. A maximum width of the film 22 in the recording medium conveyance direction is W, and a height from the recording paper conveyance surface at the upstream position of the film 22 with the maximum width is V.

In this case, a height X of the detention member 41 from the recording medium conveyance surface at the tip of the upstream wall in the conveyance direction of the recording medium is lower than V. The distance ka between the upstream wall of the detention member 41 in the conveyance direction of the recording medium and the film 22 is equal to or smaller than 5 mm. This can reduce the speed of the air flow carrying the UFP. The reason will be described below.

Figure 6A:
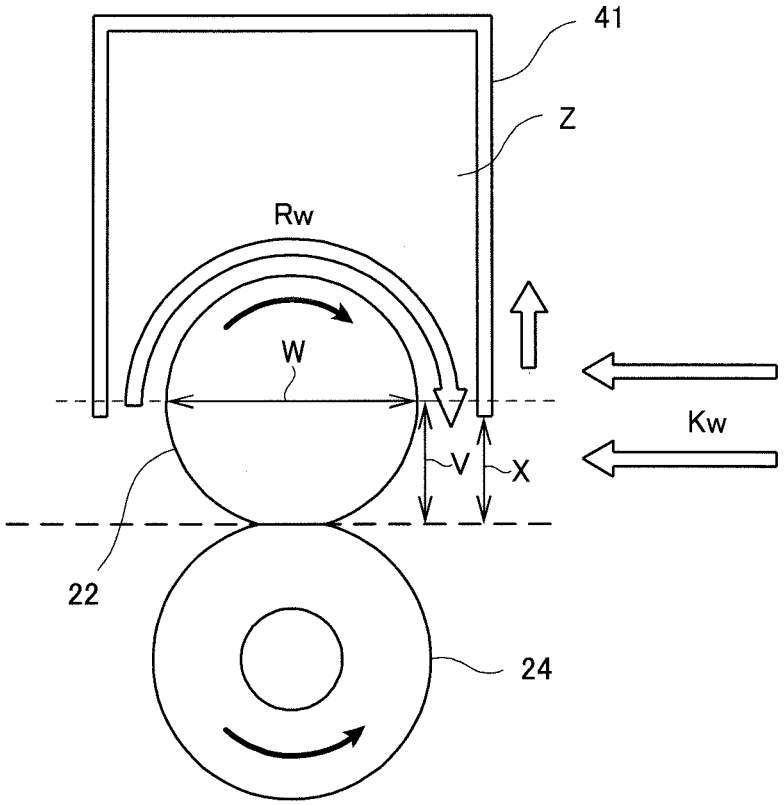
FIGS. 6A and 6B are schematic cross-sectional views of the heating apparatus according to the embodiment 1.
Figure 6B:
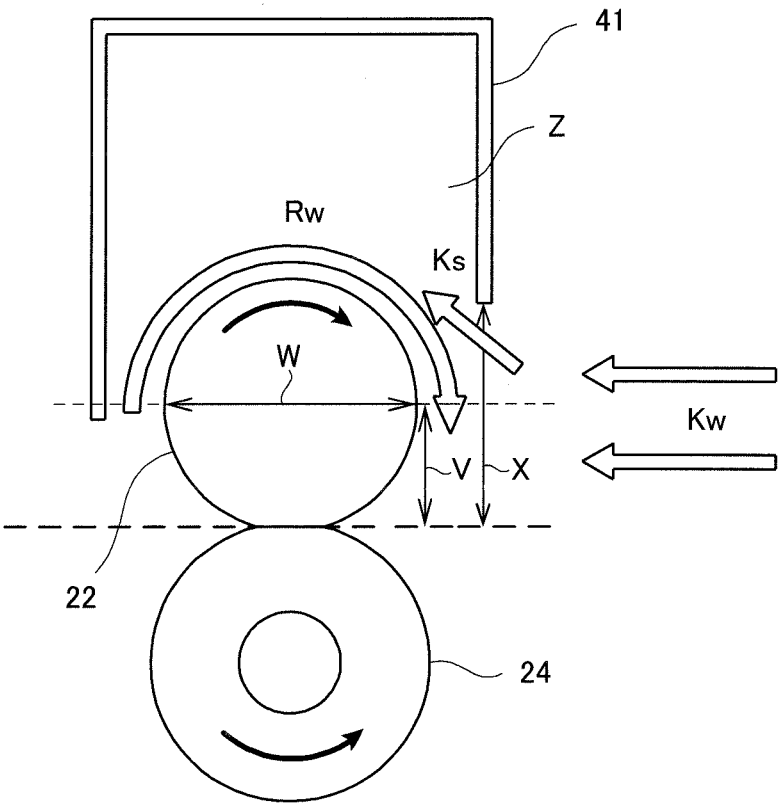

FIGS. 6A and 6B are schematic diagrams illustrating relationships between the tip position of the upstream wall of the detention member 41 and air flows Kw and Ks according to an embodiment 1. FIG. 6A illustrates a case in which the tip position of the upstream wall is lower than V, and FIG. 6B illustrates a case in which the tip position of the upstream wall is higher than V. The detention member 41 of the present embodiment uses the air flow associated with the drive of the film 22 in order to retain the UFP generated from around the film 22 in the detention member 41. More specifically, when the heating apparatus 11 is driven, an air flow Rw (hereinafter, laminar flow Rw) as illustrated in FIGS. 6A and 6B is generated on the surface of the film 22 along with the rotation of the film 22. A flow of wind associated with the conveyance of the recording medium and a flow of wind from the inside of the main body for releasing the heat of the heating apparatus 11 to the outside of the main body usually exist around the heating apparatus 11, and the air flow Kw flowing toward the heating apparatus 11 exists in the recording medium conveyance direction.

As illustrated in FIG. 6A, when the tip height X of the upstream wall of the detention member 41 in the conveyance direction of the recording medium is smaller (lower) than V, the air flow Kw does not directly blow into the retention space Z. This is because much of the air flow Kw is first blocked by the upstream wall in the recording medium conveyance direction of the detention member 41. Even when the air flow Kw is not blocked by the wall portion of the detention member 41, the air flow Kw hits the lower half of the film 22 and goes around the upstream wall (weakened as a result) to enter the retention space Z (oblique line area in FIGS. 6A and 6B) between the detention member 41 and the film 22.

As illustrated in FIG. 6B, when the tip height X of the upstream wall of the detention member 41 in the conveyance direction of the recording medium is greater (higher) than V, the air flow Ks (hereinafter, direct inflow air Ks) is generated that directly flows into the retention space Z without being blocked (weakened) by the wall portion of the detention member 41.

To reduce the release of the UFP to the outside of the device, the time that the UFP is retained in the retention space Z can be increased as much as possible, and the wind flowing in the retention space Z from the upstream to the downstream in the paper conveyance direction can be weakened. In this regard, it is desirable that the direct inflow air Ks is not generated, that is, the tip height X of the upstream wall in the paper conveyance direction of the detention member 41 is equal to or smaller than V.

To further weaken the air flowing into the detention member 41, the clearance ka between the upstream wall in the recording medium conveyance direction of the detention member 41 and the film 22 can be as small as possible to cause the inflow air to hit the laminar flow Rw to weaken the inflow air. As a result of intensive studies, the present inventor has found that the laminar flow Rw exists within a range of 5 mm from the surface of the film 22. Therefore, it is desirable that the value of ka is within a range of 5 mm or less.

Figure 10:
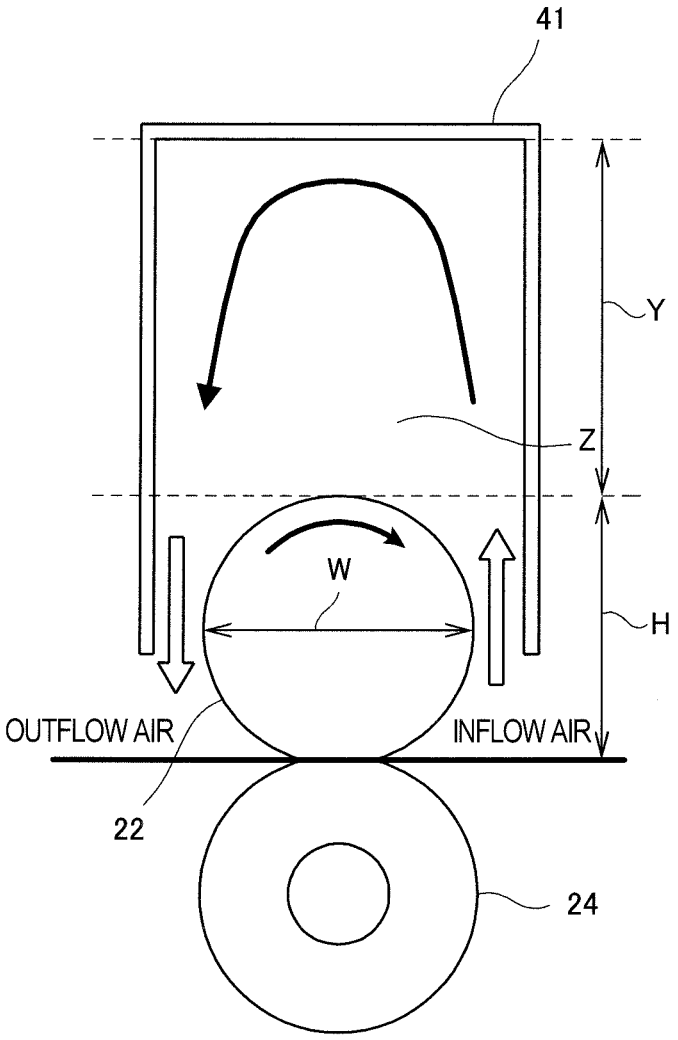
FIG. 10 is a schematic cross-sectional view illustrating a path of air flowing into a retention space.

A larger retention space Z is better, and it is particularly effective to increase Y in FIG. 5. This is because as illustrated in FIG. 10, a small amount of the inflow air entering the retention space Z advances in a perpendicular direction relative to the recording conveyance surface and further returns in the perpendicular direction. Therefore, the length of Y is equivalent to the length of the path of the inflow air.

Figure 7A:
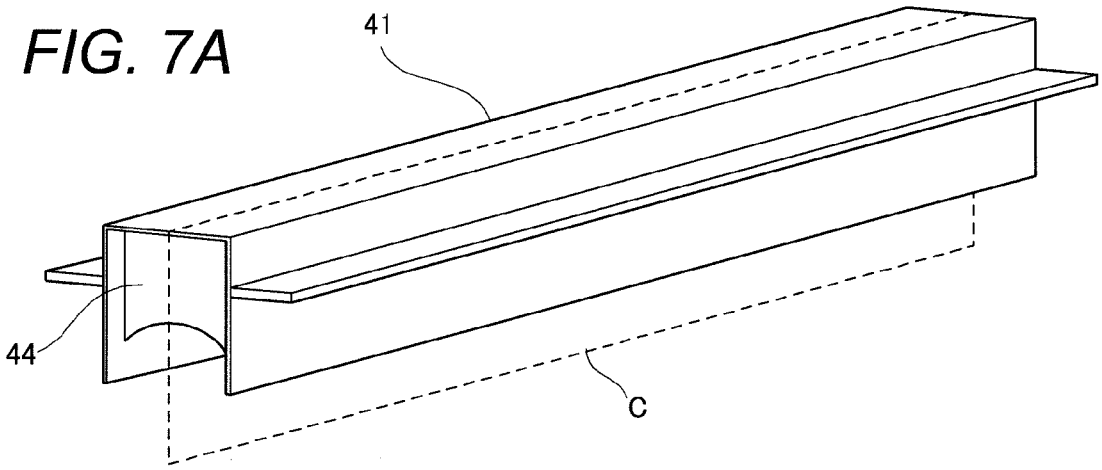
FIGS. 7A and 7B are configuration explanatory views of the detention member and a film unit according to the embodiment 1.
Figure 7B:
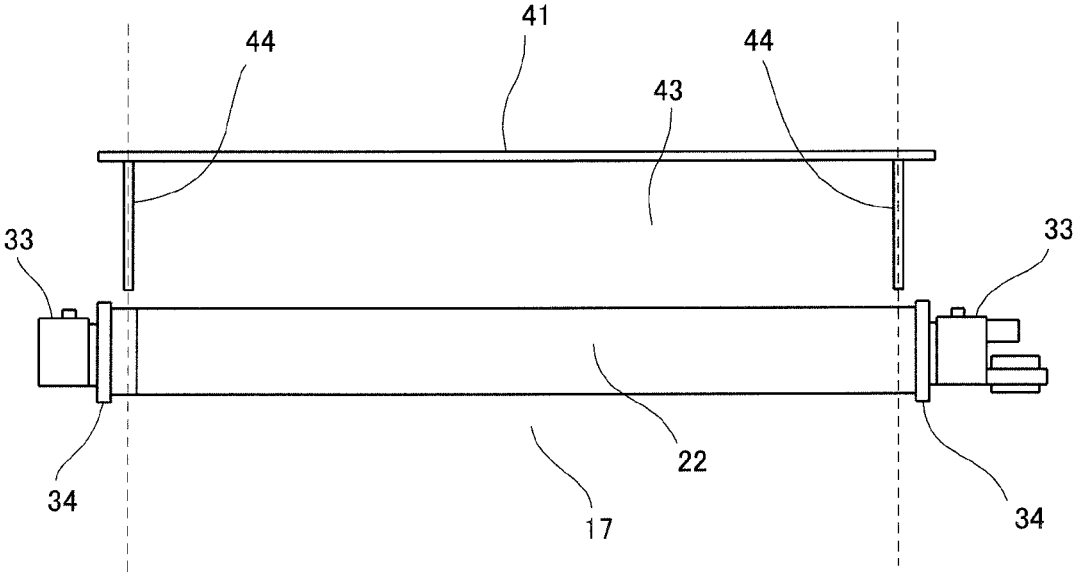

Although the air flow in the circumferential direction of the film 21 inside of the detention member 41 has been described, an air flow in the longitudinal direction also exists particularly near both ends of the detention member 41. The air flow in the longitudinal direction can also be weakened to further increase the effect of retaining the UFP. To weaken the air flow in the longitudinal direction, it is effective to provide side walls 44 for blocking the air flow in the longitudinal direction in a retention space 43 near both ends of the detention member as illustrated in FIGS. 7A and 7B. In addition, as illustrated in FIGS. 7A, 7B, 8A and 8B, a configuration of combinations of the side walls 44 for obstructing the flow of the air in the longitudinal direction and collar portions 34 of flanges 33 provided on both end portions of the film 22 can further weaken the air flow in the longitudinal direction in the retention space 43. Therefore, an effect of further reducing the release of the UFP to the outside of the device can be obtained. Specific examples will be described below. The respective side walls 44 include a surface which an extension in the longitudinal direction intersects.

Embodiment 1

FIG. 7A is a schematic perspective view illustrating a shape of the detention member 41 according to the embodiment 1 of the present invention. FIG. 7B is a schematic cross-sectional view of the detention member 41 along a virtual surface C indicated by a dotted line in FIG. 7A so that a longitudinal positional relationship of the side walls 44 arranged inside of the detention member 41 of the present embodiment can be understood. In FIG. 7B, the actual arrangement is maintained for the longitudinal positional relationship between the detention member 41 and a film unit 17, and the detention member 41 and the film unit 17 are separated in a direction orthogonal to the longitudinal direction and are vertically arranged. Dotted lines in FIG. 7B are lines indicating longitudinal positions of the side walls 44. The film unit 17 here is a unit of a combination of the film 22, the film guide 21, the U-shaped sheet metal 20, the ceramic heater 23 and the flanges 33. FIG. 7B also illustrates the collar portions 34 of the flanges. The collar portions 34 are particularly important in the present embodiment. Therefore, although the collar portions 34 are components integrated with the flanges 33 as parts for restricting the movement of the film 22 in the longitudinal direction, a different reference sign is provided.

The present embodiment is characterized by using a configuration combining the side walls (partitions) 44 as first wall portions near both ends inside of the detention member 41 and the collar portions 34 as second wall portions included in the flanges in order to weaken the air flowing in the longitudinal direction of the detention member 41. Effects of the present embodiment will be described below.

Figure 8A:
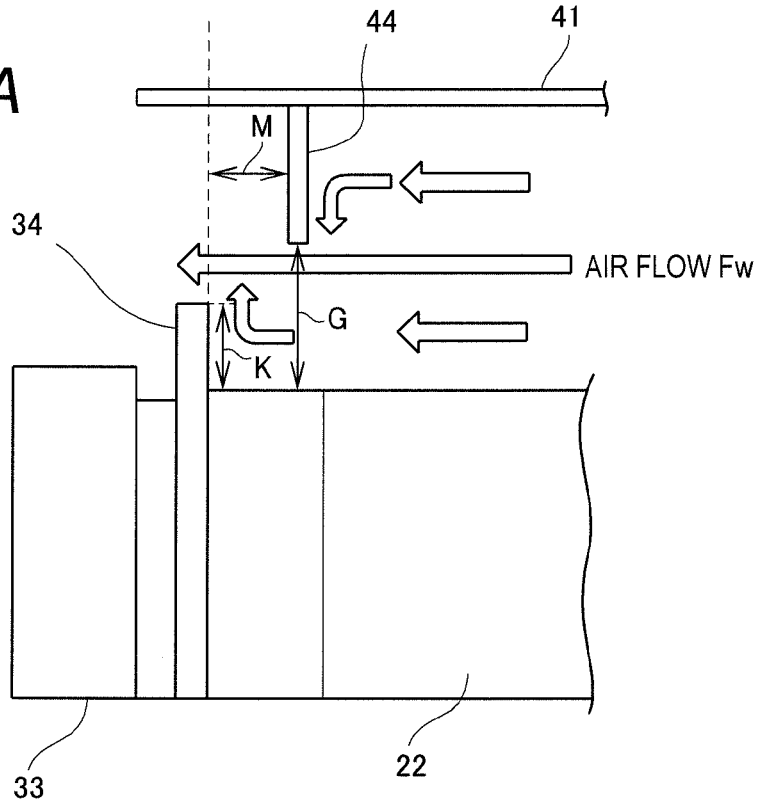
FIGS. 8A and 8B are diagrams illustrating an air flow near a side wall of the detention member and a collar portion according to the embodiment 1.
Figure 8B:
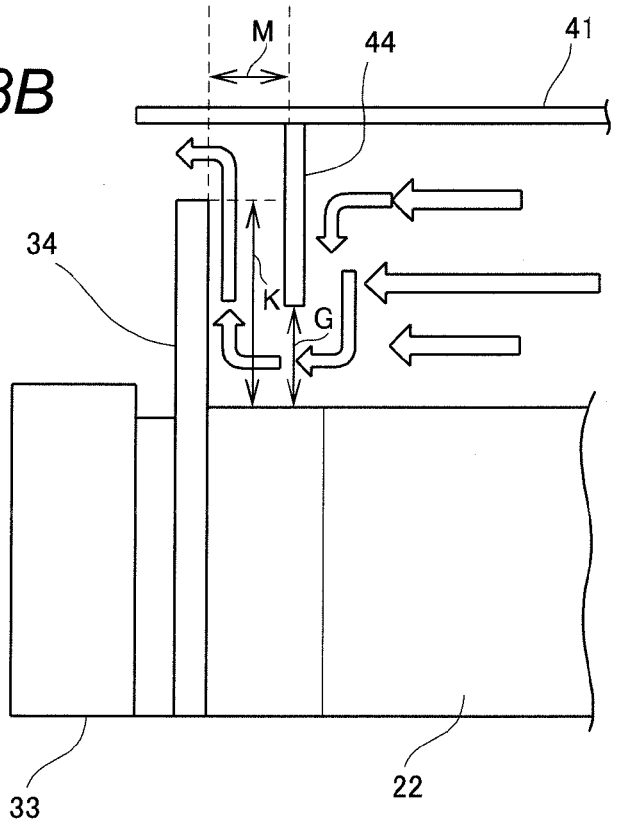

FIGS. 8A and 8B are diagrams schematically illustrating an effect on the air flow (longitudinal direction) near the film end portion when a gap G between the side wall 44 in the detention member 41 and the outer surface of the film is changed. FIG. 8A illustrates a case in which a length K from the film surface of the collar portion is smaller than G, and FIG. 8B illustrates a case in which K is greater than G. Thick arrows in FIGS. 8A and 8B indicate air flows. White (or straight) arrows indicate linear air flows, and gray (or bent) arrows indicate air flows that are bent after hitting a wall or a collar. The speed of the bent air flow is basically slower than the linear air flow. Therefore, many bent air flows (air flows of gray arrows) can be formed to slow down the air flow discharged to the outside (outside of the collar of the flange) from the detention member end portion.

In this way, an air flow bent by providing the side wall and the collar portion can be formed in upper and lower parts of the space between the film 22 and the detention member 41 to slow down the air flow. However, the following configuration can further slow down the air flow.

The gap G is provided between the side wall 44 of the detention member 41 and the film 22 to prevent the side wall 44 from coming in contact with the rotating film 22. When the gap G is greater than the length (height) K from the film surface of the collar portion 34, an air flow Fw remains that directly goes out of the detention member 41 (without hitting the collar portion 34) from the gap G as illustrated in FIG. 8A. The air flow Fw can be bent to further slow down the entire air flow. FIG. 8B is a diagram illustrating the air flow when the length (height) K of the collar portion 34 is greater than G in order to eliminate the air flow Fw directly going out of the detention member 41 from the gap G. The length K of the collar portion 34 is greater than G, and the air flow passing through the gap G hits the collar portion 34. Therefore, the air flow must go outside of the detention member 41 through a bent path, instead of a linear path like the air flow Fw of FIG. 8A. As a result, the speed of the air flowing out is weakened. It is desirable that a distance M from the collar portion 34 to the side wall 44 in the longitudinal direction is within 15 mm from the collar portion 34. The reason will be described with reference to FIG. 9.

Figure 9:
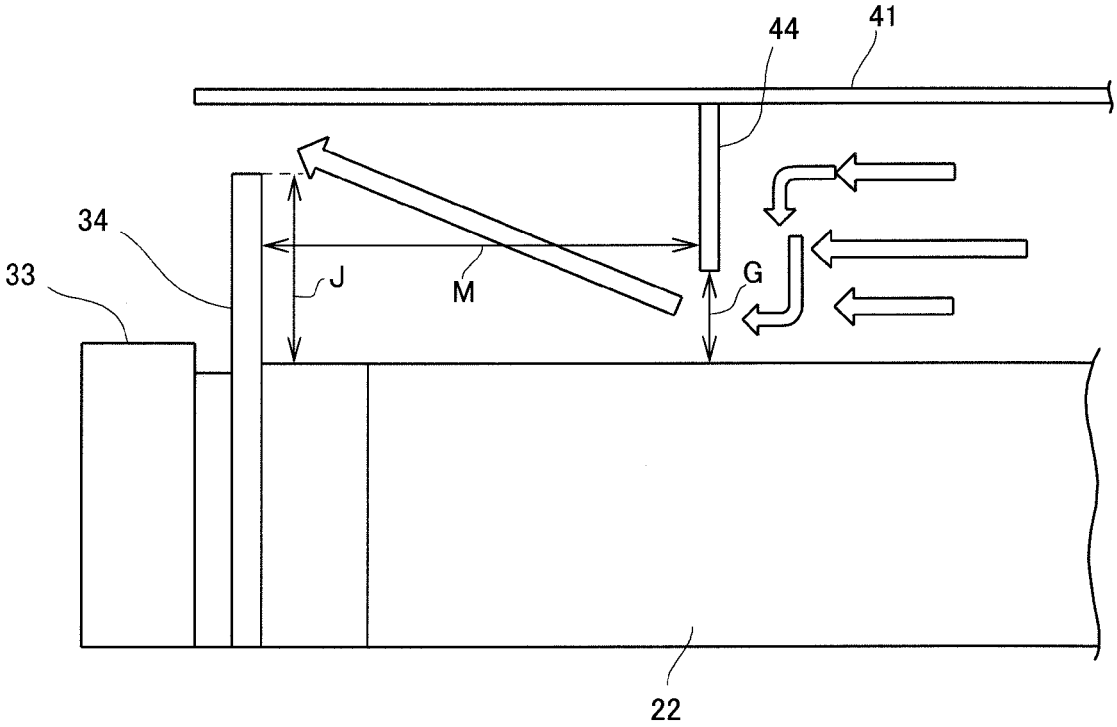
FIG. 9 is a diagram illustrating a relationship between a distance from the side wall of the detention member to the collar portion and the air flow.

FIG. 9 is a diagram schematically illustrating an air flow near the side wall 44 and the collar portion 34 when the distance M from the collar portion 34 to the side wall 44 is increased to greater than 15 mm. When M is greater than 15 mm in this way, the air flow passing by the side wall 44 tends to take a linear path that allows avoiding the collar portion 34, and the air flow can go out without slowing down.

Therefore, as illustrated in FIG. 8B, it is desirable that the side wall 44 and the collar portion 34 are arranged at a close distance from each other in opposing areas opposite to each other in the longitudinal direction so that the direction of the main flow of the air flowing in the opposing areas becomes a direction orthogonal to the longitudinal direction.

Figure 11:
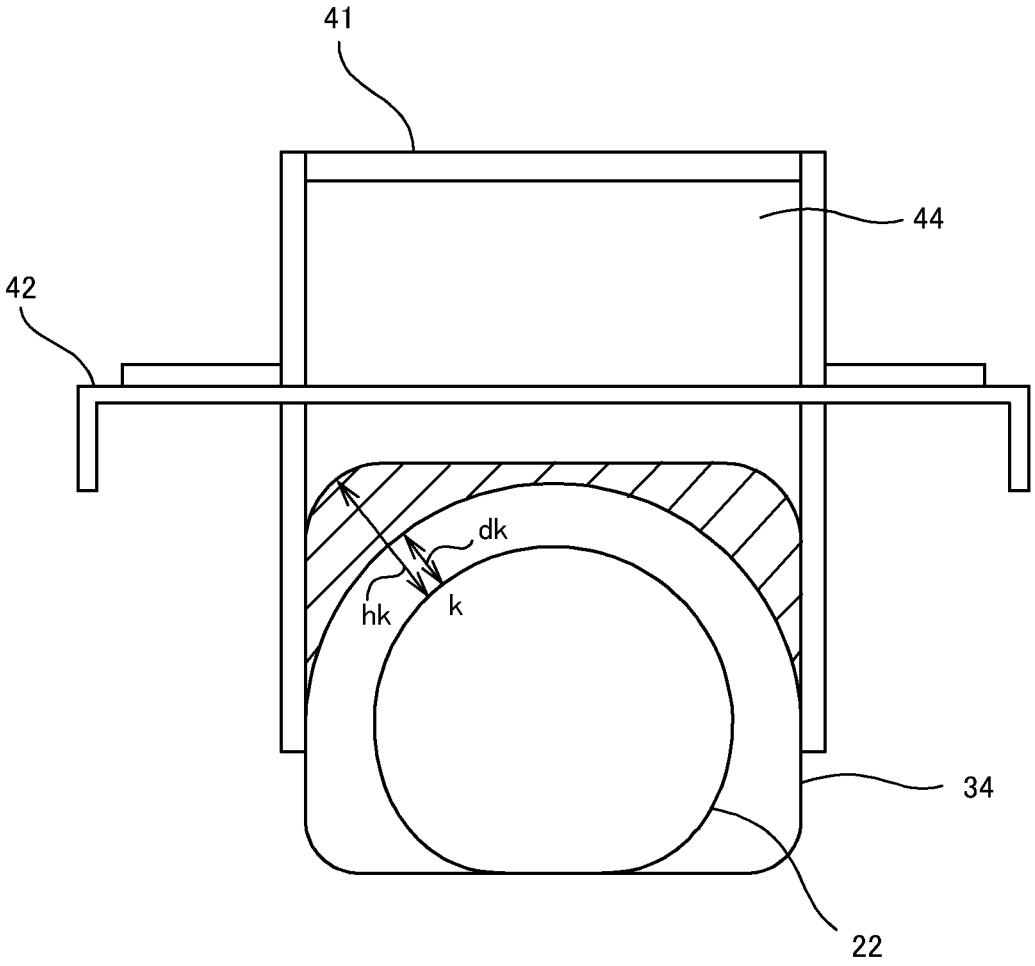
FIG. 11 is a diagram illustrating main dimensions hk and dk according to the embodiment 1.

FIG. 11 is a side surface projection view of the film unit 17 schematically illustrating definition of main dimensions of the heating apparatus 11 according to the present embodiment and is a diagram projecting the shape of the film 22, the shapes of the detention member 41 and the side wall 44, and the shape of the collar portion 34. Only the shape of the end portion is projected as for the film 22, and only the outer frame is displayed as for the collar portion 34. In FIG. 11, a part indicated by hatching illustrates an area where the side wall 44 and the collar portion 34 oppose (overlap) in the longitudinal direction as viewed in the longitudinal direction of the film 22.

In FIG. 11, a line segment dk indicates a shortest distance from an arbitrary part k on the surface of the end portion of the film 22 to a closer one of the tip of the side walls 44 arranged at both ends in the longitudinal direction and the upstream and downstream walls of the detention member 41 covering the circumferential direction of the film 22. A distance hk is a distance from the projection point k of the arbitrary part on the end portion surface of the film 22 to the tip of the collar portion 34 measured in the same direction as the line segment dk.

Other main dimensions of the heating apparatus of the embodiment 1 (main dimensions defined in FIG. 5) are as follows. The outside diameter of the film 22 is 18 mm. As a result of measurement in the state incorporated into the heating apparatus, H is 15 mm, W is 20 mm, and V is 7.5 mm. The height X from the recording paper conveyance surface of the upstream wall in the conveyance direction of the detention member is 6 mm, ka is 3 mm, and Y is 10 mm. The material of the detention member 41 is PEEK.

Figure 12A:
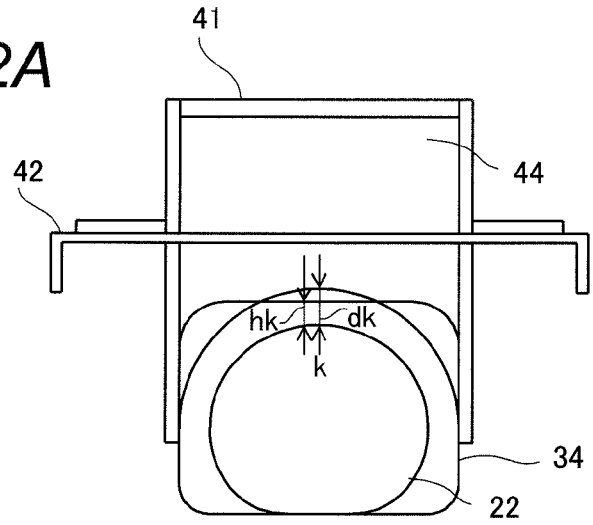
FIGS. 12A, 12B and 12C are projection views illustrating surface configurations according to embodiments 1-1 to 1-3.
Figure 12B:
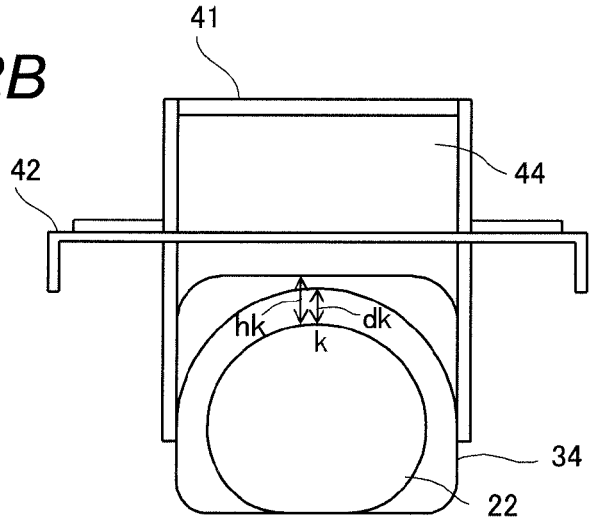
Figure 12C:
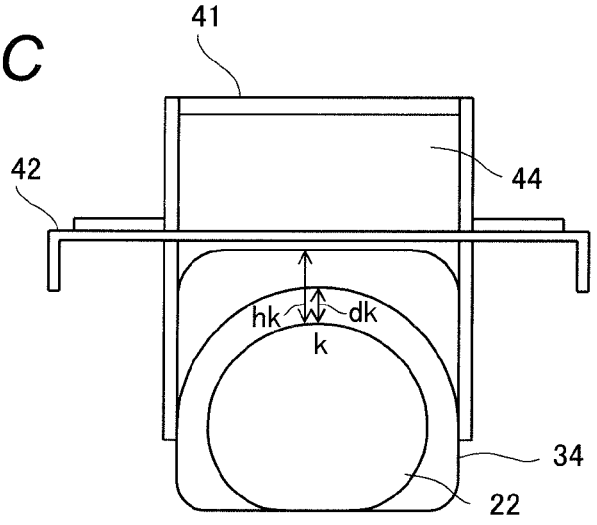
Figure 14:
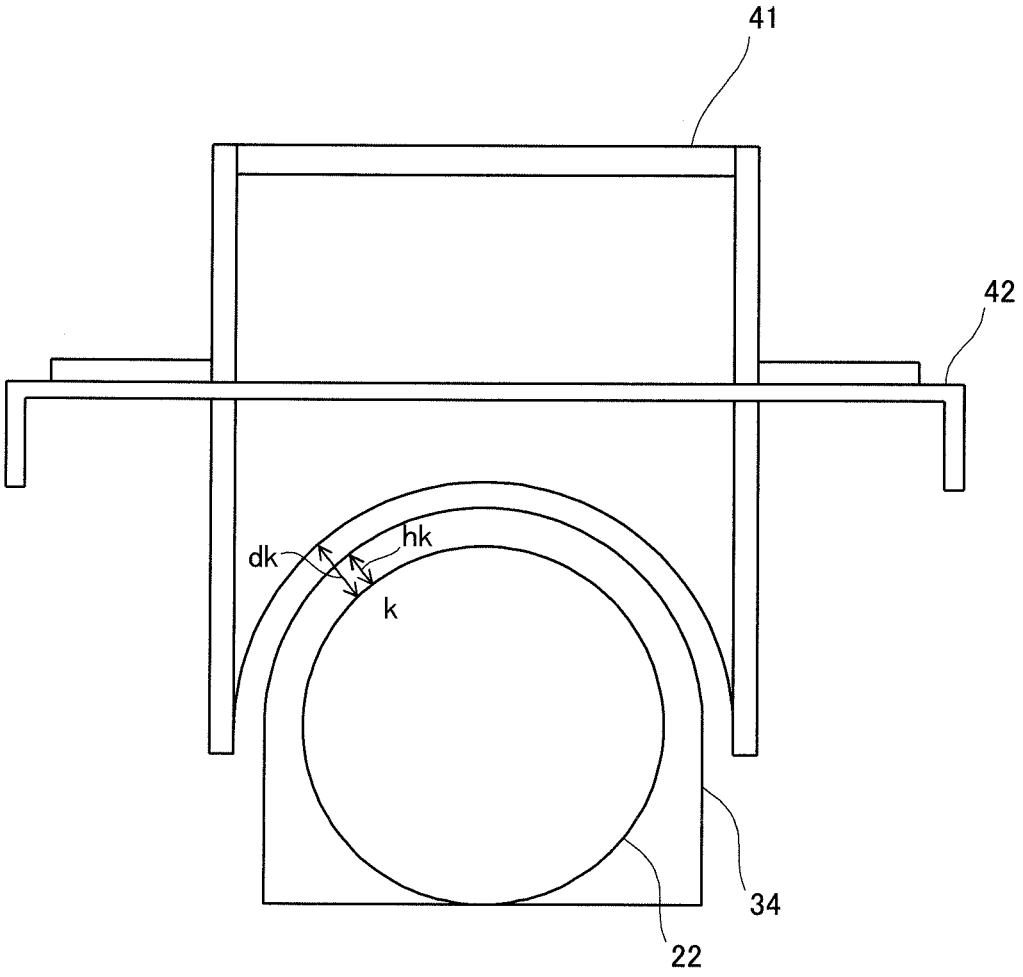
FIG. 14 is a projection view illustrating a surface configuration of an embodiment 1-4.

Based on the configuration, the shapes of the detention member 41 and the side wall 44 and the shape of the collar portion 34 (dk and hk of FIG. 11) are set as follows in order to illustrate the effects of the present embodiment. FIGS. 12A to 12C are projection views schematically illustrating surface configurations of embodiments 1-1 to 1-3 as specific examples of the embodiment 1. FIG. 12A illustrates the embodiment 1-1, FIG. 12B illustrates the embodiment 1-2, and FIG. 12C illustrates the embodiment 1-3. In FIGS. 12A to 12C, parts indicated by hatching illustrate areas where the side wall and the collar portion 34 oppose in the longitudinal direction (area overlapping each other as viewed in the longitudinal direction). FIG. 14 is a projection view schematically illustrating a surface configuration of an embodiment 1-4 as a specific example of the embodiment 1.

Embodiment 1-1

As illustrated in the projection view of FIG. 12A, the collar portion and the wall of the detention member overlap on the projection view, except at least near the top of the film 22 (point with maximum height from the recording medium conveyance surface) in the area covering the detention member in the film circumference. Therefore, hk≥dk . . . Expression (i) is satisfied. Specifically, hk is 2.0 mm, and dk is 3.0 mm at the top of the film 22.

Embodiment 1-2

As illustrated in the projection view of FIG. 12B, the collar portion and the wall of the detention member overlap on the projection view (Expression (i) is satisfied) in the entire area covering the detention member in the film circumference. Specifically, only the shape of the collar portion 34 in the height direction (direction perpendicular to the recording medium conveyance surface) is changed from the embodiment 1-1. At the top of the film 22, hk is 4.0 mm, and dk is 3.0 mm.

Embodiment 1-3

As illustrated in the projection view of FIG. 12C, the collar portion and the wall of the detention member overlap in the entire area of the film circumference covering the detention member (Expression (i) is satisfied), and the area where the collar portion and the wall of the detention member overlap is greater than in the embodiment 1-2. Specifically, only the shape of the collar portion 34 in the height direction (direction perpendicular to the recording medium conveyance surface) is changed from the embodiment 1-1. At the top of the film 22, hk is 6.0 mm, and dk is 3.0 mm.

Embodiment 1-4

As illustrated in the projection view of FIG. 14, the same detention member 41 as in the embodiment 1-1 is used, and only the shape of the collar portion is different from the embodiment 1-1. More specifically, in the projection view of FIG. 14, there is no area where the collar portion 34 and the wall of the detention member 41 overlap in the entire circumference of the film 22 in the area where the detention member 41 covers the film 22 (hk is 2.0 mm, and dk is 3.0 mm).

Comparative Example 1

Figure 13A:
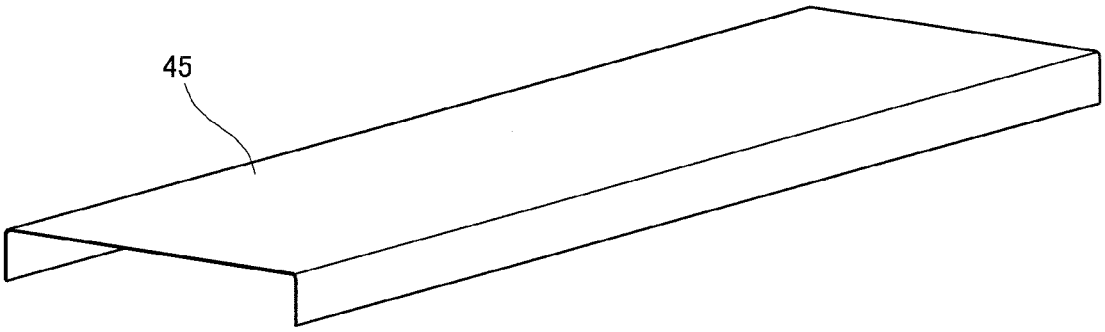
FIGS. 13A and 13B are diagrams illustrating a configuration of a comparative example 1.
Figure 13B:
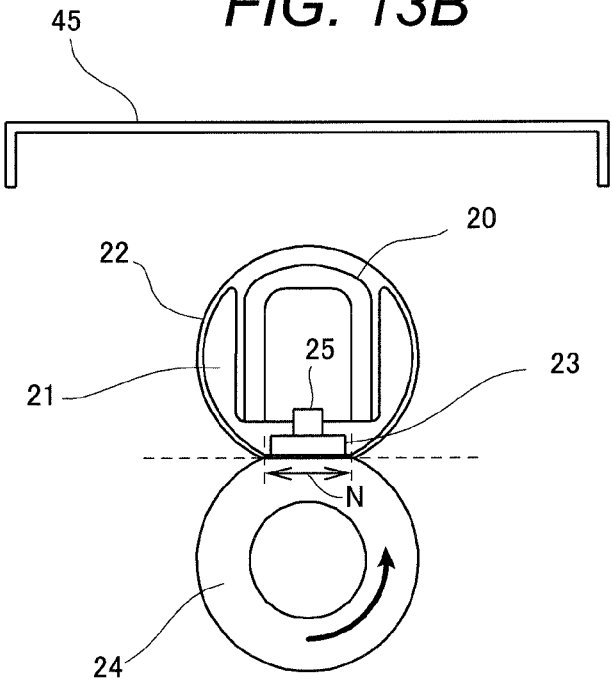

FIGS. 13A and 13B are diagrams schematically illustrating a configuration of a comparative example 1. FIG. 13A is a perspective view of a top plate frame 45 of the comparative example 1, and FIG. 13B is a side surface cross-sectional view of the heating apparatus of the comparative example 1. As illustrated in FIGS. 13A and 13B, the heating apparatus of the present comparative example does not include the detention member 41. As illustrated in FIG. 13A, a hole for fitting the detention member is not provided on the top plate frame 45 of the present comparative example. Therefore, as illustrated in FIG. 13B, the top plate frame 45 is separated from the film 22 and arranged and fixed above the film 22 just like the position of the top plate frame of the specific example 1, through a fixing frame (not illustrated). The configuration of the present comparative example is the same as in the embodiment 1-1, except that the detention member 41 is not included and that the top plate frame 45 does not include a hole for fitting the detention member. Note that a UFP concentration value in the configuration of the comparative example 1 is called a value of Ref, and the value is used as a parameter for calculating a reduction rate in each specific example.

Comparative Example 2

Figure 15:
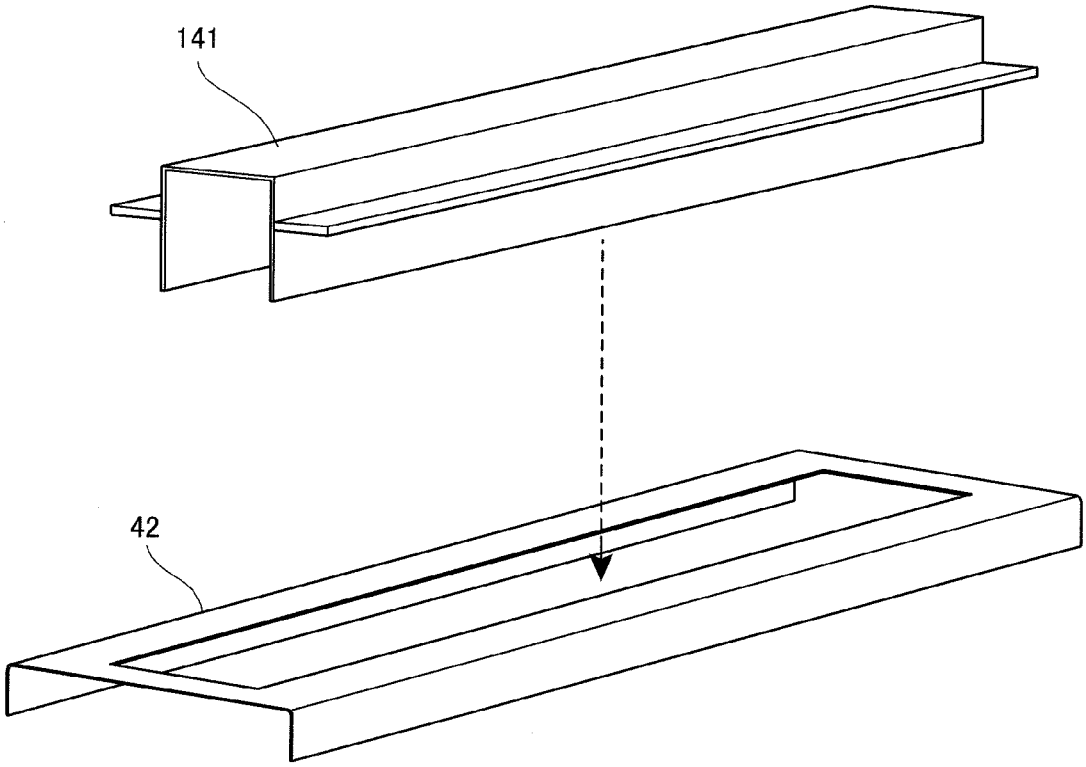
FIG. 15 is a diagram illustrating a configuration of a comparative example 2.

FIG. 15 is a diagram schematically illustrating a configuration of a comparative example 2, illustrating a perspective view of a detention member 141 and the top plate frame 42. In the comparative example 2, the detention member 141 illustrated in FIG. 15 is attached to the top plate, in place of the detention member 41 in the configuration of the embodiment 1-1. Compared to the detention member 41 of the embodiment 1-1, the detention member 141 does not include the side walls 44, and other than that, the configuration is the same as the detention member 41.

The following Table 1 illustrates results of actual measurement of the UFP in the embodiments and the comparative examples.

TABLE 1

| Configuration | hk | dk | UFP Concentration | Reduction Rate |
|---|---|---|---|---|
| Embodiment 1-1 (partially hk ≥ dk) | 2 | 3 | 15500 | 69% |
| Embodiment 1-2 (entirely hk ≥ dk, small overlap area) | 4 | 3 | 14000 | 72% |
| Embodiment 1-3 (entirely hk ≥ dk, large overlap area) | 6 | 3 | 12000 | 76% |
| Embodiment 1-4 (entirely hk < dk, no overlap area) | 2 | 3 | 23250 | 54% |
| Comparative example 1 (w/o detention member, Ref) | — | 3 | 50000 | 0% |
| Comparative example 2 (w/detention member, w/o side wall) | — | 3 | 28000 | 44% |

To evaluate the UFP, a sealed chamber of 3 cubic meters is filled with purified air, and an image forming apparatus is installed in the chamber. The UFP concentration in the chamber just after five minutes of continuous printing of an image with a printing rate of 5% is measured. A nanoparticle size distribution measurement device FMPS 3091 (TSI Inc.) is used for the measurement. A monochrome LPB with a process speed of about 230 mm/second and 40 ppm is used as the image forming apparatus. Here, the unit of the UFP concentration is parts/$cm^3$·second, and a reduction rate denotes a value indicating a ratio of reduction in the UFP concentration relative to the UFP concentration of the comparative example 1 (Ref) without the detention member.

It can be understood from the results of the embodiment 1-4 and the comparative example 2 of Table 1 that the arrangement of just the side walls 44 on the detention member 41 is more effective than the comparative example. It can also be understood that the concentration of the generated UFP can be effectively reduced by forming the flanges around the end portions of the fixing roller (fixing film) of the image fixing apparatus and the detention member in desired shapes. More specifically, the UFP concentration can be more effectively reduced by forming an area with hk≥dk (area where the side walls 44 and the collar portions 34 oppose each other in the longitudinal direction). It can also be understood that the generated UFP concentration can be more effectively reduced by making hk greater than dk and further increasing the area where the collar portions 34 and the detention member side walls 44 overlap in the side surface projection view.

In the description above, the effects of the present embodiment have been described by illustrating an example of the air flow from the inside to the outside of the detention member at the detention member end portion with reference to FIGS. 8A and 8B. Conversely, when there is air flowing from the outside of the detention member to the inside of the detention member at the detention member end portion, the direction of the inflow air is just opposite to FIGS. 8A and 8B, and the path is bent as in FIGS. 8A and 8B. Therefore, it is obvious that there are effects of weakening the air flow and effects of reducing the UFP concentration in the same way.

Although the example of the heating apparatus of the film heating system has been described in the present embodiment, the present invention can also be applied to a heating fixing apparatus of a heat roller system and to an image forming apparatus including the heating fixing apparatus. Although the wall portions of the detention member and the collar portions are formed as in the configuration described above at both sides of the retention space in the longitudinal direction in the present embodiment, the configuration may be adopted only on one side.

According to the present embodiment, the detention member and flange configuration can be used to effectively retain the UFP generated by the wax and the fixing grease inside of the detention member (retention space). Therefore, the number of UFPs released to the outside of the image forming apparatus can be reduced by condensing the UFPs through the retention or by progressing the adsorption of the UFPs inside of the detention member.

Embodiment 2

In an embodiment 2 of the present invention, the configuration of the detention member of the embodiment 1 is improved to obtain an effect of further reducing the UFP concentration. In the embodiment 2, differences from the embodiment 1 will be mainly described. Matters not described here in the embodiment 2 are the same as in the embodiment 1.

Figure 16A:
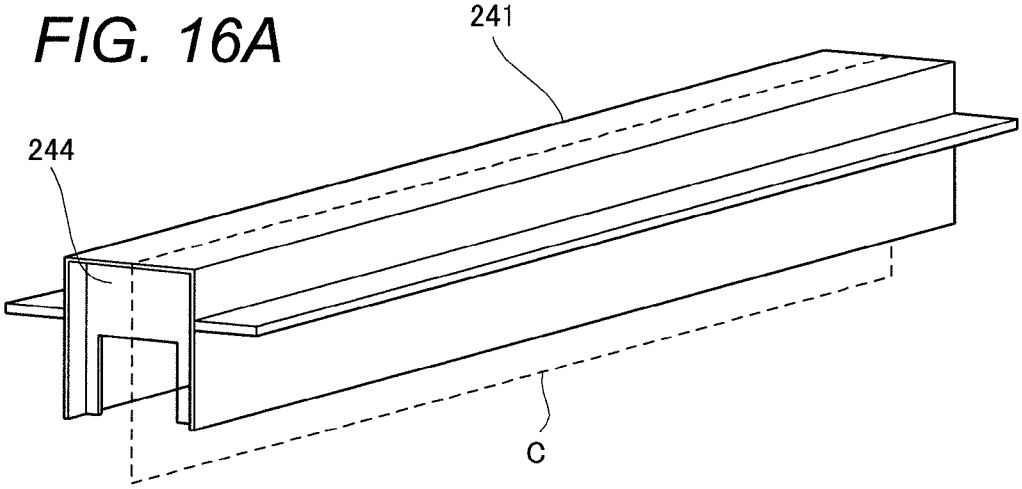
FIGS. 16A, 16B and 16C are configuration explanatory views of the heating apparatus according to an embodiment 2.

FIG. 16A is a perspective view of a detention member 241 of the embodiment 2 of the present invention. Configurations of a heating apparatus and an image forming apparatus of the embodiment 2 are the same as in the embodiment 1, except for the detention member 241, flanges 233 and collar portions 234. The detention member 241 is fitted in the frame of the top plate frame 42 as in the embodiment 1. Therefore, the top plate frame 42 is fixed to the fixing frame (not illustrated) that is the outer frame of the heating apparatus, and the detention member 241 is fixed on the film 22 (opposite side of the nip portion N).

Figure 16B:
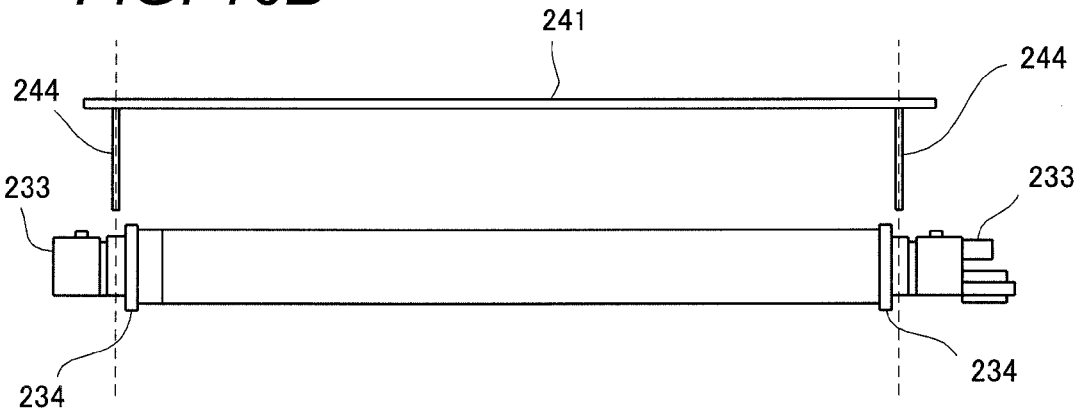

FIG. 16B is a cross-sectional view cutting the detention member 241 of the present embodiment along a virtual surface C indicated by a dashed line in FIG. 16A. The detention member 241 and the film unit are arranged separately from each other compared to the actual arrangement so that the positional relationship can be easily understood. Dashed lines in FIG. 16B indicate longitudinal positions of side walls 244. As can be understood from FIG. 16B, the present embodiment is characterized in that the side walls 244 of the detention member are arranged outside of the collar portions 234 in the longitudinal direction.

Although the wax in the toner is a main and large contributor as a generation source of the UFP, the UFP is also generated from the fixing grease for reducing the friction between the film and the heater in some cases. The UFP caused by the fixing grease is discharged outside from both ends of the film 22, that is, from between the film 22 and the collar portions 234. Therefore, it is desirable that the collar portions 234 are also inside of the detention member 241 in order to reduce the discharge of the UFP caused by the fixing grease to the outside of the device. As a result, the UFP discharged from between the end portions of the film 22 and the collar portions 234 can be retained inside of the detention member 241 (retention space Z).

Figure 16C:
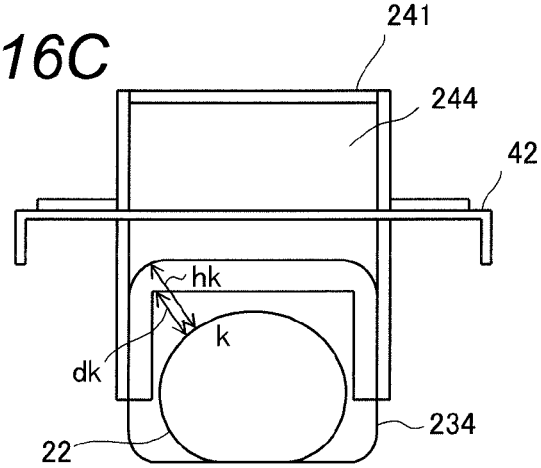

FIG. 16C is a side surface projection view of the heating apparatus according to the present embodiment and is a diagram illustrating an overlapping area of the side wall 244 of the detention member and the collar portion 234 according to the present embodiment. In the present embodiment, the collar portion and the wall of the detention member overlap on the projection view in the entire area of the film circumference covering the detention member 241 as illustrated in FIG. 16C (hk≥dk . . . Expression (i) is satisfied).

The following Table 2 illustrates results of actual measurement of the UFP based on the configuration described above. For comparison, the results of the comparative example 1 of the embodiment 1 without the detention member are also provided.

TABLE 2

| Configuration | UFP Concentration | Reduction Rate |
|---|---|---|
| Embodiment 2 | 9900 | 80% |
| Comparative example 1 (w/o detention member) | 50000 | 0% |

The UFP concentration is evaluated by the same method as in the embodiment 1. More specifically, a sealed chamber of 3 cubic meters is filled with purified air, and an image forming apparatus is installed in the chamber. The UFP concentration after five minutes of continuous printing of an image with a printing rate of 5% is measured. A nanoparticle size distribution measurement device FMPS 3091 (TSI Inc.) is used for the measurement as in the embodiment 1.

As can be understood from the results of Table 2, the UFP concentration of the embodiment 2 is lower than in the comparative example 1. It can also be understood that the reduction rate of the UFP concentration is large in the embodiment 2 compared to the results of the embodiment 1 (Table 1). This is because the UFP caused by the grease generated from both ends of the film 22 that is easily discharged to the outside in the detention member 41 of the embodiment 1 can be imported inside (retention space) of the detention member 241 in the detention member 241 of the embodiment 2.

Although the example of the heating apparatus of the film heating system has been described in the present embodiment, the present invention can also be applied to, for example, a pressure film side end portion configuration using a heat roller system fixing roller and a pressure film internally using grease for reducing the friction.

Embodiment 3

In an embodiment 3 of the present invention, the detention member and the flanges of the embodiment 2 are improved to obtain an effect of further reducing the UFP concentration. In the embodiment 3, differences from the embodiments 1 and 2 will be mainly described. Matters not described here in the embodiment 3 are the same as in the embodiments 1 and 2.

In the embodiment 3, collar portions and side walls of a detention member can be engaged to more thoroughly retain the UFP inside of the detention member than in the embodiment 2, and the detention member and the flange portions are integrated. In the embodiment 2, the side walls of the detention member are arranged outside of the collar portion to easily import the UFP caused by the fixing grease discharged from both end portions of the fixing film to the inside of the detention member. As a result, the UFP concentration can be reduced more than in the embodiment 1. However, there is still a gap between the side wall 244 of the detention member and the collar portion 234 in the embodiment 2, and there is an air flow path going through the gap. Therefore, a small amount of air flowing to the outside of the detention member or air flowing to the inside from the outside of the detention member may be inevitably generated. In this regard, the collar portions and the detention member are integrated to eliminate the gap in the embodiment 3.

Embodiment 3-1

Figure 17A:
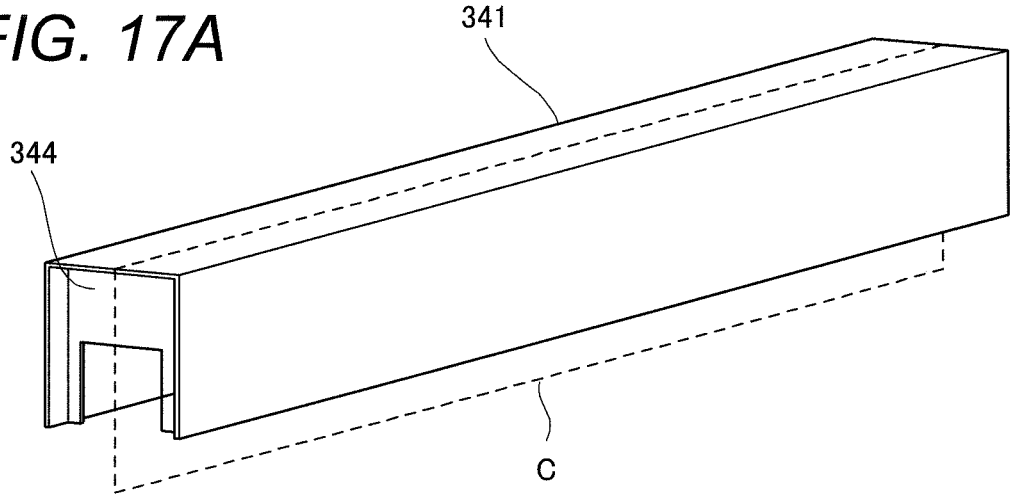
FIGS. 17A, 17B and 17C are configuration explanatory views of the heating apparatus according to an embodiment 3-1.
Figure 17B:
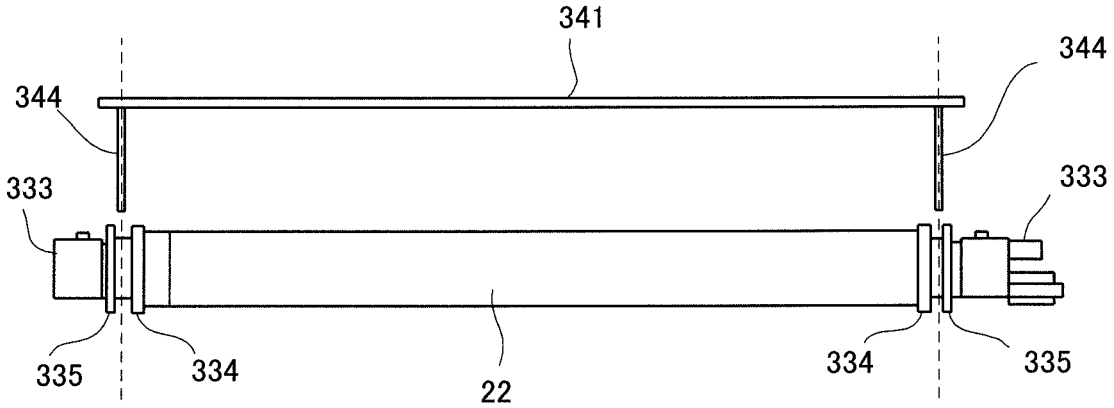
Figure 17C:
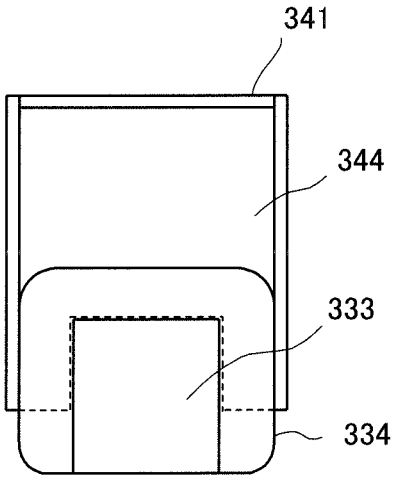

FIGS. 17A to 17C illustrate a configuration of an embodiment 3-1 as a specific example of the embodiment 3. FIG. 17A is a perspective view of a detention member 341 of the embodiment 3-1. Although the detention member is supported by the top plate frame 42 in the embodiments 1 and 2, flanges 333 hold the detention member 341 in the embodiment 3-1.

FIG. 17B illustrates a cross section cutting the detention member 341 along the virtual surface C indicated by a dashed line in FIG. 17A. The detention member 341 and the film unit are arranged separately from each other compared to the actual arrangement so that the positional relationship can be understood. Dashed lines in FIG. 17B indicate longitudinal positions of side walls 344 of the detention member of the present embodiment. As illustrated in FIG. 17B, second collar portions 335 (third wall portions) are added to the outside of first collar portions 334 in the longitudinal direction. Therefore, the side walls 344 of the detention member are held and placed between two types of collars, the first collar portions 334 and the second collar portions 335.

FIG. 17C is a diagram of a state that the flange 333 and the second collar portion 335 of the flange of the embodiment 3 are engaged with the side wall 344 of the detention member 341 as viewed from the side (direction orthogonal to the recording medium conveyance direction). A dotted line illustrates a shape of a notch part of the side wall 344 hidden by the collar portion 335. In this way, the shape of the notch portion of the side wall 344 corresponds to the outer shape of the flange 333.

Embodiment 3-2

Figure 18A:
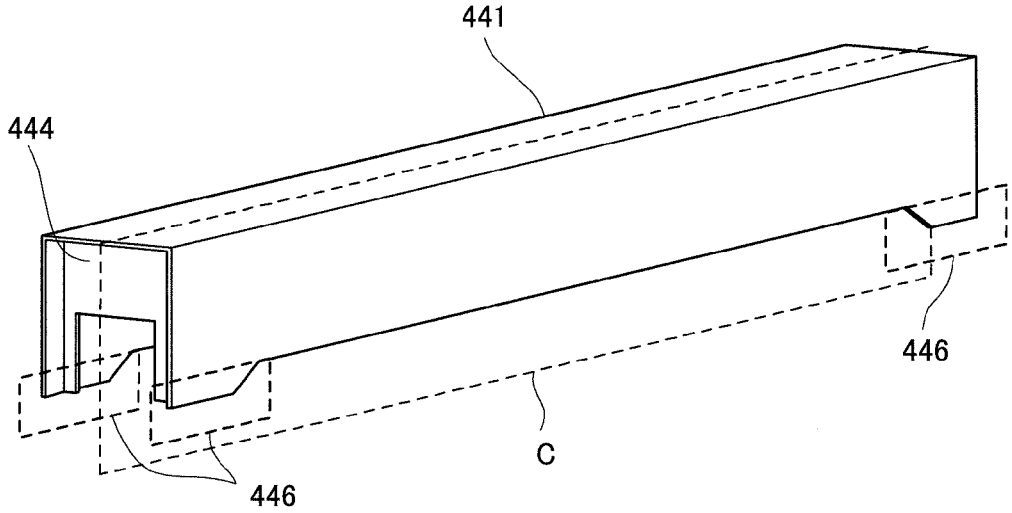
FIGS. 18A and 18B are configuration explanatory views of the heating apparatus of an embodiment 3-2.

FIG. 18A illustrates a configuration of an embodiment 3-2 as a specific example of the embodiment 3. FIG. 18A is a perspective view of a detention member of the embodiment 3-2. As illustrated in FIG. 18A, the embodiment 3-2 is characterized by providing extension portions 446 (end portion opposing areas) in which both end portions in the longitudinal direction are extended toward the recording medium conveyance surface side compared to center portions, on upstream and downstream walls (fourth wall portions) in the conveyance direction of a detention member 441.

Figure 18B:
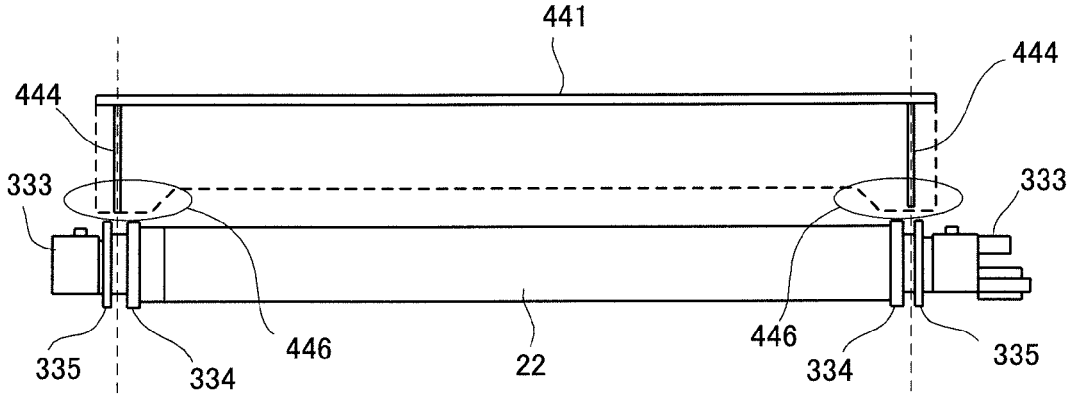

FIG. 18B illustrates an arrangement of the detention member of the embodiment 3-2. FIG. 18B illustrates a cross section of the detention member 441 cut along the virtual surface C indicated by the dotted line in FIG. 18A. The detention member 441 and the film unit are arranged separately from each other compared to the actual arrangement so that the positional relationship can be understood. In FIG. 18B, dotted lines illustrate an arrangement of the detention member 441 and the film unit of the heating apparatus as well as the upstream and downstream walls in the conveyance direction of the detention member 441 such that the extension portions 446 of the detention member 441 can be recognized. Positions of side walls 444 of the embodiment 3-2 are also indicated by dashed lines.

Figure 19A:
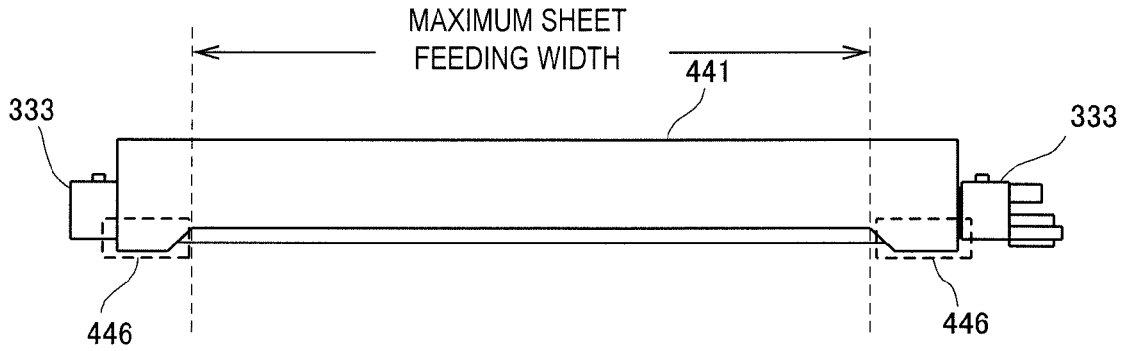
FIGS. 19A and 19B are configuration explanatory views of the heating apparatus according to the embodiment 3-2.
Figure 19B:
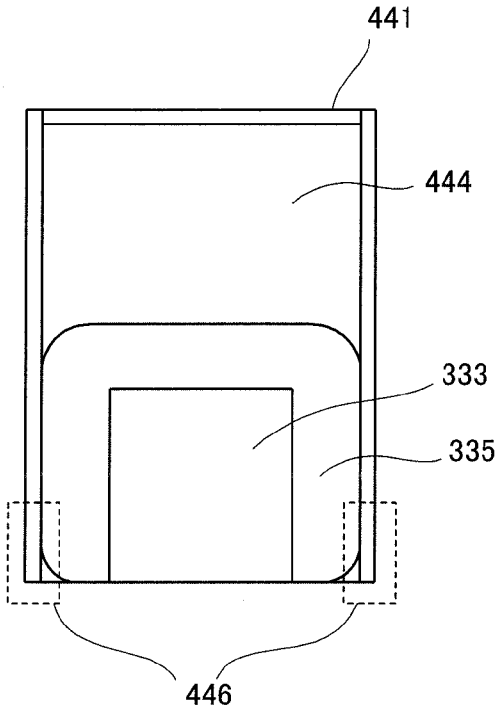

FIG. 19A is a front view of a state in which the detention member 441 of the embodiment 3-2 is engaged with the film unit, illustrating that the extension portions (side cover extension portions) 446 of both end portions of the detention member 441 are arranged outside of a maximum sheet feeding width of the present heating apparatus. FIG. 19B is a diagram of a state that the flange 333 and the second collar portion 335 of the flange of the embodiment 3-2 are engaged with the side wall 444 of the detention member 441 as viewed from the side (direction orthogonal to the recording medium conveyance direction). The configuration of the embodiment 3-2 is the same as in the embodiment 3-1, except for the detention member 441 and the side walls 444. As illustrated in FIGS. 19A and 19B, the detention member 441 includes areas opposing the end portions of the film 22 in the recording medium conveyance direction, on the upstream and downstream walls (fourth wall portions) opposing the film 22 in the recording medium conveyance direction, outside of the conveyance path of the recording medium in the longitudinal direction. The areas (end portion opposing areas) are extended to substantially the same height as the conveyance path surface in a direction perpendicular to the conveyance path surface of the recording medium.

The following Table 3 illustrates results of actual measurement of the UFP using the embodiments 3-1 and 3-2. For comparison, the results of the comparative example 1 of the embodiment 1 without the detention member are also provided.

TABLE 3

| Configuration | UFP Concentration | Reduction Rate |
|---|---|---|
| Embodiment 3-1 | 8700 | 83% |
| Embodiment 3-2 | 6200 | 88% |
| Comparative example 1 (w/o detention member) | 50000 | 0% |

The UFP concentration is evaluated by the same method as in the embodiment 1. More specifically, a sealed chamber of 3 cubic meters is filled with purified air, and an image forming apparatus is installed in the chamber. The UFP concentration after five minutes of continuous printing of an image with a printing rate of 5% is measured. A nanoparticle size distribution measurement device FMPS 3091 (TSI Inc.) is used for the measurement as in the embodiment 1.

As can be understood from the results of Table 3, the UFP concentration in the configurations of the embodiments 3-1 and 3-2 is reduced compared to the comparative example 1. It can also be understood that the reduction rate of the UFP concentration is higher compared to the results of the embodiment 2. In the embodiment 2, a small amount of UFP caused by the grease generated from both ends of the film is discharged to the outside from the gap between the first collar portion 234 and the side wall 244. In the embodiment 3, the side walls 344 are engaged and integrated between the first collar portions 334 and the second collar portions 335, and the gap is eliminated (retention space is closed in the longitudinal direction). Therefore, the UFP caused by the grease can be effectively imported to the retention space. It can also be understood that the reduction rate of the UFP concentration of the embodiment 3-2 of the embodiment 3 is larger than that of the embodiment 3-1. The reason will be described with reference to FIGS. 20A and 20B.

Figure 20A:
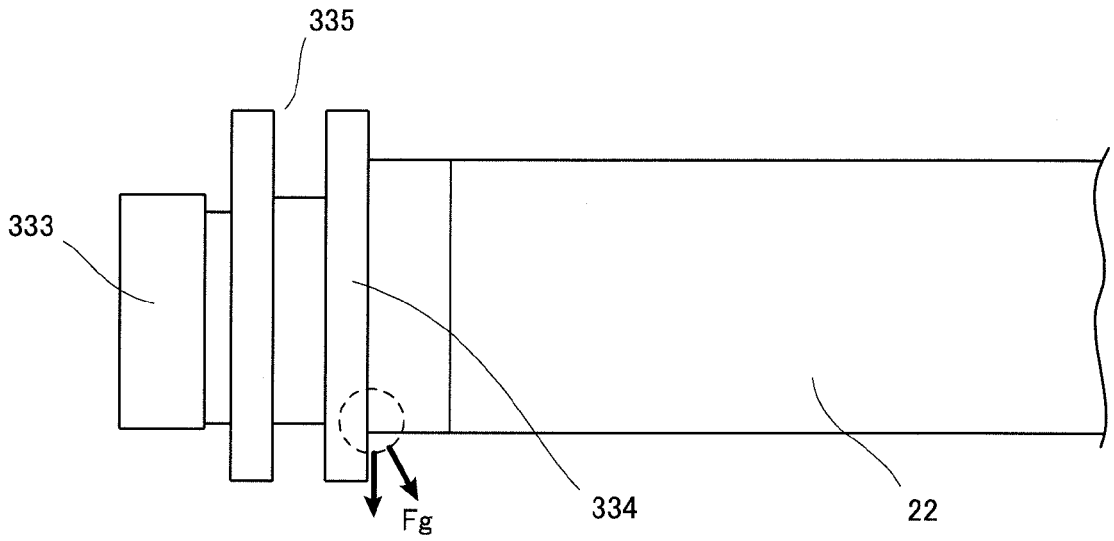
FIGS. 20A and 20B are diagrams illustrating outflow sections of UFP caused by grease.
Figure 20B:
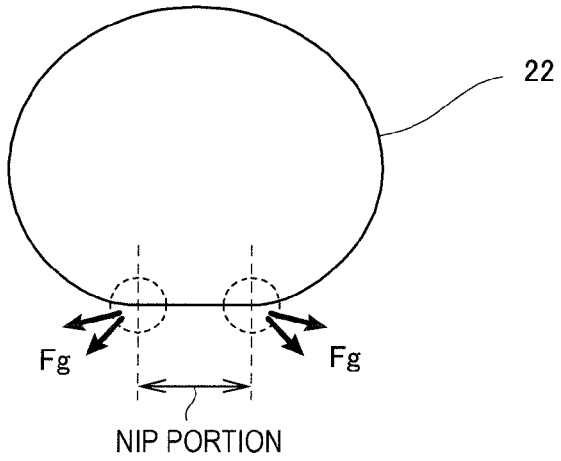

FIG. 20A is a diagram illustrating an outflow section of the UFP caused by the grease. FIG. 20A illustrates a state of the outflow of the UFP in the longitudinal direction, and FIG. 20B illustrates a state in the side surface direction. FIG. 20A schematically illustrates air flows Fg of the UFP caused by the grease flowing out to the outside from the inside of the film 22. The curvature of the cross-sectional shape of the film 22 in the circumferential direction significantly changes at edges of the nip portion formed by the film 22 and the pressure roller 24 as illustrated in FIG. 20B. More specifically, the shape is linear at the nip portion and is circular or elliptic close to a circle at the other parts. The UFP caused by the grease particularly tends to flow out from the parts where the curvature changes (parts surrounded by dotted lines in FIGS. 20A and 20B). Therefore, the parts are also covered by the extension portions 446 of the detention member 441 in the embodiment 3-2 so that the UFP flowing out from the parts also enters inside of the detention member. As a result, the UFP caused by the grease can be put into the detention member more effectively than in the embodiment 3-1, and the reduction rate of the UFP concentration can be further increased.

In this way, the UFP can be retained in the detention member in the embodiment 3 more effectively than in the embodiment 2, and the UFP concentration can be more effectively reduced. In the embodiment 3-2, the extension portions 446 are provided at both end portions in the longitudinal direction of both upstream and downstream walls positioned in the recording medium conveyance direction of the detention member 441. The extension portion 446 may be provided only on one of the upstream wall and the downstream wall, and even in that case, the UFP concentration can be reduced more than in the embodiment 3-1. However, the effect of reducing the UFP concentration is the highest when the extension portions 446 are provided on both of the upstream and downstream walls as in the embodiment 3-2.

The present invention has been described in the embodiments based on the heating apparatus of the film system. However, a fluorine oil or a silicone oil is used on the heat roller inner surface in some cases when an induction heating system is used as a heating system of the heat roller or when a radiation type heater, such as a halogen heater, is used in place of the ceramics substrate heater. The present invention can also be applied to such a configuration, and it is obvious that the concentration of the generated UFP can be effectively reduced in the same way in the configuration.

The configurations of the embodiments can be combined with each other as much as possible. For example, the configuration of the embodiment 1 may be adopted for the configuration of the side wall (first wall portion) of the detention member and the collar portion (second wall portion) at one of the end portions, and the configuration of the embodiment 3 may be adopted at the other end portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-119552, filed Jun. 12, 2015, which is hereby incorporated by reference herein in its entirety.

What is claimed is:

1. A fixing apparatus that fixes a toner image on a recording medium, the apparatus comprising:

a heating rotary member configured to heat the toner image;

a pressure member configured to come in contact with the heating rotary member to form a nip portion, wherein the recording medium, on which the toner image is formed, is conveyed at the nip portion;

a cover extending in a longitudinal direction of the heating rotary member, configured to cover a part of an outer surface of the heating rotary member to form a space between the cover and the heating rotary member, the cover having a partition, on a longitudinal end portion thereof, perpendicular to a longitudinal direction of the cover and partitioning the space and an outside of the space, the partition of the cover being provided inside of a longitudinal end surface of the heating rotary member in the longitudinal direction of the cover, the partition of the cover extending in a direction approaching the outer surface of the heating rotary member to form a gap between the outer surface of the heating rotary member and the partition of the cover when viewed in the longitudinal direction of the cover; and a flange provided outside of the longitudinal end surface of the heating rotary member on the same side as the partition of the cover in the longitudinal direction of the cover, the flange including an extending portion extending in a direction away from the outer surface of the heating rotary member and overlapping with the gap when viewed in the longitudinal direction of the cover.

2. An apparatus according to claim 1, wherein the partition of the cover and the extending portion of the flange overlap when viewed in the longitudinal direction of the cover.

3. An apparatus according to claim 1, wherein the extending portion of the flange is a first extending portion, and the flange includes a second extending portion outside of the first extending portion in the longitudinal direction of the cover, and wherein the partition of the cover is provided between the first extending portion and the second extending portion of the flange.

4. An apparatus according to claim 1, wherein the heating rotary member is a cylindrical film.

5. An apparatus according to claim 4, wherein the extending portion of the flange restricts movement of the film in the longitudinal direction of the film, by coming in contact with the longitudinal end surface of the film when the film moves in the longitudinal direction of the film.

6. An apparatus according to claim 1, wherein the space is long in the direction away from the outer surface of the heating rotary member, and the space is short in a conveyance direction of the recording medium.

7. An apparatus according to claim 1, wherein the cover includes a side cover portion that covers at least one of an upstream outer surface and a downstream outer surface of the heating rotary member in a conveyance direction of the recording medium.

8. A fixing apparatus that fixes a toner image on a recording medium, the apparatus comprising:

a heating rotary member configured to heat the toner image;

a pressure member configured to come in contact with the heating rotary member to form a nip portion, wherein the recording medium, on which the toner image is formed, is conveyed at the nip portion;

a cover extending in a longitudinal direction of the heating rotary member, configured to cover a part of an outer surface of the heating rotary member to form a space between the cover and the heating rotary member, the cover having a partition, on a longitudinal end portion thereof, perpendicular to a longitudinal direction of the cover and partitioning the space and an outside of the space, the partition of the cover extending in a direction approaching the outer surface of the heating rotary member when viewed in the longitudinal direction of the cover, the cover including a side cover portion that covers at least one of an upstream outer surface and a downstream outer surface of the heating rotary member in a conveyance direction of the recording medium; and a flange provided outside of the longitudinal end surface of the heating rotary member on the same side as the partition of the cover in the longitudinal direction of the cover, the flange including an extending portion extending in a direction away from the outer surface of the heating rotary member and overlapping with the partition of the cover when viewed in the longitudinal direction of the cover.

9. An Apparatus according to claim 8, wherein the heating rotary member is a cylindrical film.

10. A fixing apparatus that fixes a toner image on a recording medium, the apparatus comprising:

a heating rotary member configured to heat the toner image;

a pressure member configured to come in contact with the heating rotary member to form a nip portion, wherein the recording medium, on which the toner image in formed, is conveyed at the nip portion; and a cover extending in a longitudinal direction of the heating rotary member, configured to cover a part of an outer surface of the heating rotary member to form a space between the cover and the heating rotary member, the cover having a partition, on a longitudinal end portion thereof, perpendicular to a longitudinal direction of the cover and partitioning the space and an outside of the space, the partition of the cover being provided inside of a longitudinal end surface of the heating rotary member in the longitudinal direction of the cover, the partition of the cover extending in a direction approaching the outer surface of the heating rotary member to form a gap between the outer surface of the heating rotary member and the partition of cover when viewed in the longitudinal direction of the cover.

* * * * *